US010189253B2

(12) United States Patent
Horiuchi

(10) Patent No.: US 10,189,253 B2
(45) Date of Patent: Jan. 29, 2019

(54) LIQUID EJECTION HEAD AND METHOD FOR PRODUCING THE SAME

(71) Applicant: CANON KABUSHIKI KAISHA, Tokyo (JP)

(72) Inventor: Isamu Horiuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/707,680

(22) Filed: Sep. 18, 2017

(65) Prior Publication Data

US 2018/0086080 A1 Mar. 29, 2018

(30) Foreign Application Priority Data

Sep. 28, 2016 (JP) ..... 2016-189754
Sep. 28, 2016 (JP) ..... 2016-189755

(51) Int. Cl.

| | |
|---|---|
| ***B41J 2/14*** | (2006.01) |
| ***B05D 3/02*** | (2006.01) |
| ***B41J 2/16*** | (2006.01) |
| *B41J 2/01* | (2006.01) |

(52) U.S. Cl.

CPC ..... *B41J 2/1404* (2013.01); *B05D 3/0263* (2013.01); *B41J 2/1603* (2013.01); *B41J 2/1606* (2013.01); *B41J 2/1626* (2013.01); *B41J 2/1631* (2013.01); *B41J 2/1645* (2013.01); *B41J 2002/012* (2013.01); *B41J 2002/14475* (2013.01)

(58) Field of Classification Search

CPC ..... B41J 2/1404; B41J 2/1603; B41J 2/1606; B41J 2002/1447; B05D 3/0263

See application file for complete search history.

(56) References Cited

U.S. PATENT DOCUMENTS 8,551,351 B2 * 10/2013 Nakamoto ..... B41J 2/1433 216/27

FOREIGN PATENT DOCUMENTS

| | | |
|---|---|---|
| JP | 2007518587 A | 7/2007 |
| JP | 2011207235 A | 10/2011 |

* cited by examiner

*Primary Examiner* — Geoffrey S Mruk

(74) *Attorney, Agent, or Firm* — Canon U.S.A., Inc. IP Division

(57) ABSTRACT

A liquid ejection head includes a substrate; and an ejection orifice-forming member formed on the substrate and including an ejection orifice configured to eject liquid and a liquid channel communicating with the ejection orifice. The ejection orifice-forming member includes an ejection orifice-forming member layer A, an intermediate water-repellent layer, and an ejection orifice-forming member layer B in this order from a substrate-side of the member. The ejection orifice-forming member also includes a protrusion protruding into the ejection orifice, and the ejection orifice-forming member includes a water-repellent projection portion that is at least a portion of the intermediate water-repellent layer and that projects farther into the ejection orifice than the ejection orifice-forming member layer A and the ejection orifice-forming member layer B.

19 Claims, 13 Drawing Sheets

LIQUID EJECTION HEAD AND METHOD FOR PRODUCING THE SAME

BACKGROUND OF THE INVENTION

Field of the Invention

The disclosure relates to a liquid ejection head and a method for producing the liquid ejection head.

Description of the Related Art

Liquid ejection heads configured to eject liquid are applied to, for example, inkjet recording heads configured to eject ink onto a recording medium to thereby perform recording. In general, an inkjet recording head includes fine ejection orifices and channels, and plural energy generating elements configured to eject ink. In recent years, inkjet recording heads have come to be designed so as to have a large number of ejection orifices, and so as to eject ink droplets having a small size. As a result, some ink droplets that are ejected but do not contribute to printing have come to be no longer negligible. Specifically, for example, ink droplets that are to impact on recording media are each divided into plural droplets (a main droplet and satellite droplets), so that the formed images have poor quality; and ink droplets lose velocity and become floated before impact on recording media, and these floating ink droplets (hereafter mist) adhere to members of the recording apparatus and are transferred onto recording media. Japanese Patent Laid-Open No. 2011-207235 has disclosed that protrusions are formed within an ejection orifice and ink is held between the protrusions. This configuration enables a decrease in the length of tails of ink droplets upon ejection and a reduction in the amount of satellite droplets and mist.

SUMMARY OF THE INVENTION

The disclosure provides a liquid ejection head that enables a reduction in the amount of satellite droplets and mist to improve printing quality, and also enables an improvement in ejection stability at the time of restarting of liquid ejection.

A liquid ejection head according to an embodiment of the disclosure includes a substrate; and an ejection orifice-forming member formed on the substrate and including an ejection orifice configured to eject liquid and a liquid channel communicating with the ejection orifice, wherein the ejection orifice-forming member includes an ejection orifice-forming member layer A, an intermediate water-repellent layer, and an ejection orifice-forming member layer B in this order from a substrate-side of the member, the ejection orifice-forming member includes a protrusion protruding into the ejection orifice, and the ejection orifice-forming member includes a water-repellent projection portion that is at least a portion of the intermediate water-repellent layer and that projects farther into the ejection orifice than the ejection orifice-forming member layer A and the ejection orifice-forming member layer B.

A method for producing a liquid ejection head according to an embodiment of the disclosure includes a step of forming, on a substrate, a shape member used for forming a liquid channel and formed of a channel-forming resin composition; a step of forming, on the shape member and the substrate, a layer that is formed of a photosensitive resin composition A and that is curable into an ejection orifice-forming member layer A; a step of forming, on the layer formed of the photosensitive resin composition A, a layer that is formed of a photosensitive resin composition C and that is curable into an intermediate water-repellent layer; a step of forming, on the layer formed of the photosensitive resin composition C, a layer that is formed of a photosensitive resin composition B and that is curable into an ejection orifice-forming member layer B; a step of exposing the layer formed of the photosensitive resin composition A, the layer formed of the photosensitive resin composition C, and the layer formed of the photosensitive resin composition B, to form a pattern of an ejection orifice for ejecting liquid, a protrusion protruding into the ejection orifice, and a water-repellent projection portion; a step of removing unexposed regions from the layer formed of the photosensitive resin composition A, the layer formed of the photosensitive resin composition C, and the layer formed of the photosensitive resin composition B; and a step of removing the shape member, wherein the water-repellent projection portion is at least a portion of the intermediate water-repellent layer, and projects farther into the ejection orifice than the ejection orifice-forming member layer A and the ejection orifice-forming member layer B.

Further features and aspects of the disclosure will become apparent from the following description of numerous example embodiments with reference to the attached drawings.

DESCRIPTION OF THE EMBODIMENTS

Figure 1A:
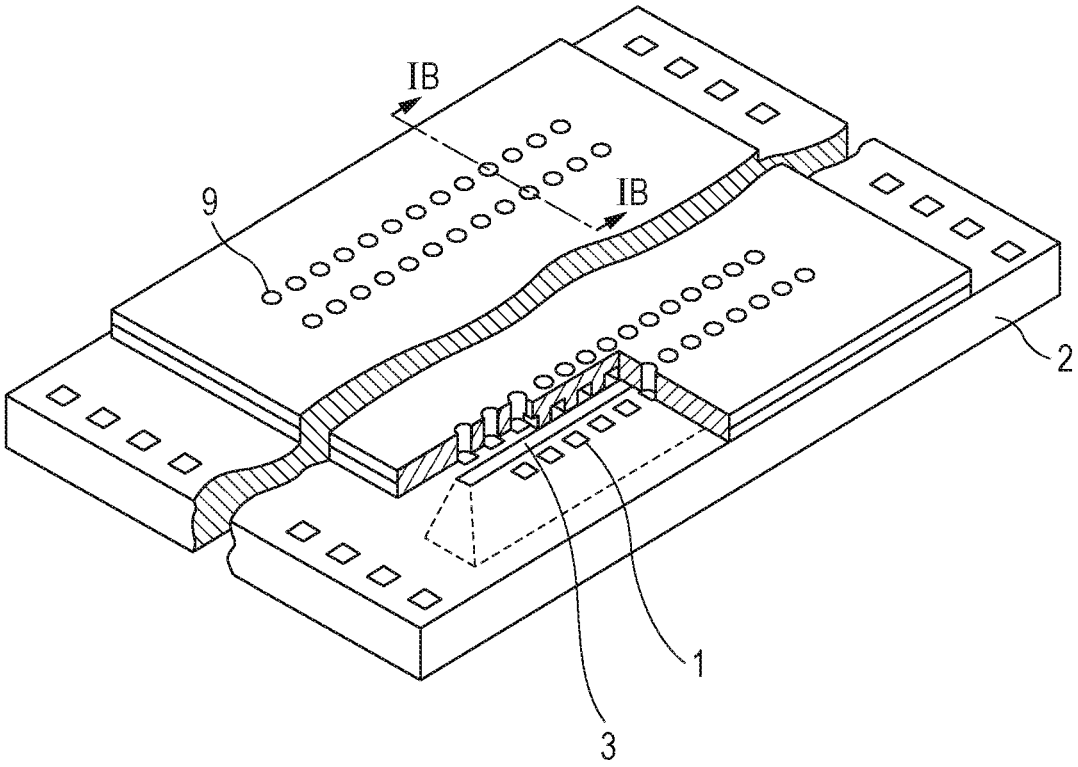
FIGS. 1A and 1B are a perspective view and a sectional view that illustrate an example of an inkjet recording head according to a first embodiment of the disclosure.

The protrusions within ejection orifices disclosed in Japanese Patent Laid-Open No. 2011-207235 enable a reduction in the amount of satellite droplets and mist. However, formation of such protrusions in an ejection orifice results in an increase in the length of the periphery of the ejection orifice, which results in an increase in the forward resistance within the ejection orifice.

There are some cases where, after termination (for some time) of printing using ink droplets ejected from an inkjet recording head, printing restarted is not appropriately performed because ink droplets are not ejected or ink droplets do not go straight and do not impact on the intended positions on printing media. Such defective ejection at the time of restarting of ejection is probably caused because, during termination of printing, ink within the ejection orifices has evaporated, which results in an increase in the ink viscosity.

Another factor that causes the defective ejection at the time of restarting of ejection is the above-described forward resistance within the ejection orifices. In other words, when the forward resistance within ejection orifices is excessively high, ink is less likely to be ejected and defective ejection is likely to occur. With ejection orifices having protrusions, in order to provide the effect of reducing the amount of satellite droplets and mist, liquid needs to be held with the protrusions at the time of ejection. For this reason, the protrusions are formed so as to have a large size sufficient for this purpose. In other words, when protrusions where ink is held provide a high resistance, the effect of reducing the amount of satellite droplets and mist is enhanced. However, such protrusions cause an increase in the forward resistance, so that defective ejection tends to occur at the time of restarting of ejection.

Thus, while ejection orifices having protrusions are employed to reduce the amount of satellite droplets and mist to thereby improve printing quality, ejection stability needs to be improved at the time of restarting of ejection.

A liquid ejection head according to an embodiment of the subject disclosure includes a substrate; and an ejection orifice-forming member formed on the substrate and including an ejection orifice configured to eject liquid and a liquid channel communicating with the ejection orifice. The ejection orifice-forming member includes an ejection orifice-forming member layer A, an intermediate water-repellent layer, and an ejection orifice-forming member layer B in this order from a substrate-side of the member. The ejection orifice-forming member includes a protrusion protruding into the ejection orifice. The ejection orifice-forming member includes a water-repellent projection portion that is at least a portion of the intermediate water-repellent layer and that projects farther into the ejection orifice than the ejection orifice-forming member layer A and the ejection orifice-forming member layer B.

The liquid ejection head according to this embodiment includes, within the ejection orifice, a protrusion protruding into the ejection orifice, so that the protrusion holds liquid to thereby decrease the length of the tails of droplets at the time of ejection of droplets. This results in a reduction in the amount of satellite droplets and mist, to thereby improve printing quality. In addition, since the liquid ejection head according to this embodiment includes a water-repellent projection portion that is at least a portion of the intermediate water-repellent layer and that projects into the ejection orifice, the meniscus of the liquid can be positioned at the water-repellent projection portion within the ejection orifice. As a result, even in the presence of the protrusion, a decrease in the forward resistance within the ejection orifice can be achieved, so that, after termination of printing, ejection stability at the time of restarting of ejection of liquid can be improved. In addition, without decreasing the thickness of the ejection orifice-forming member, a decrease in the forward resistance within the ejection orifice can be achieved. As a result, the rigidity of the ejection orifice-forming member can be maintained.

First Example Embodiment

Liquid Ejection Head

A liquid ejection head according to this embodiment includes a substrate; and an ejection orifice-forming member formed on the substrate and including an ejection orifice configured to eject liquid and a liquid channel communicating with the ejection orifice. The ejection orifice-forming member includes an ejection orifice-forming member layer A, an intermediate water-repellent layer, and an ejection orifice-forming member layer B in this order from a substrate-side of the member. The ejection orifice-forming member includes a protrusion protruding into the ejection orifice. The ejection orifice-forming member includes a water-repellent projection portion that is at least a portion of the intermediate water-repellent layer and that projects farther into the ejection orifice than the ejection orifice-forming member layer A and the ejection orifice-forming member layer B. The water-repellent projection portion is formed at least on an area of the inner wall of the ejection orifice, the area not being the surface of the protrusion.

The liquid ejection head according to this embodiment includes, within the ejection orifice, a protrusion protruding into the ejection orifice, so that the protrusion holds liquid to thereby decrease the length of the tails of droplets at the time of ejection of droplets. This results in a reduction in the amount of satellite droplets and mist, to thereby improve printing quality. In addition, since the liquid ejection head according to this embodiment includes a water-repellent projection portion that is formed at least on an area of the inner wall of the ejection orifice, the area not being the surface of the protrusion, that is at least an area of the intermediate water-repellent layer, and that projects into the ejection orifice, the meniscus of the liquid can be positioned at the water-repellent projection portion within the ejection orifice. As a result, even in the presence of the protrusion, a decrease in the forward resistance within the ejection orifice can be achieved, so that, after termination of printing, ejection stability at the time of restarting of ejection of liquid can be improved. In addition, without decreasing the thickness of the ejection orifice-forming member, a decrease in the forward resistance within the ejection orifice can be achieved. As a result, the rigidity of the ejection orifice-forming member can be maintained.

Hereinafter, this embodiment according to the disclosure will be described with reference to drawings. An example to which the disclosure is applicable will be described with reference to an inkjet recording head, which is one example of liquid ejection heads. However, the scope to which a liquid ejection head according to the disclosure is applicable is not limited to the inkjet recording head.

FIG. 1A is a schematic view that illustrates an example of the inkjet recording head according to this embodiment.

Figure 1B:
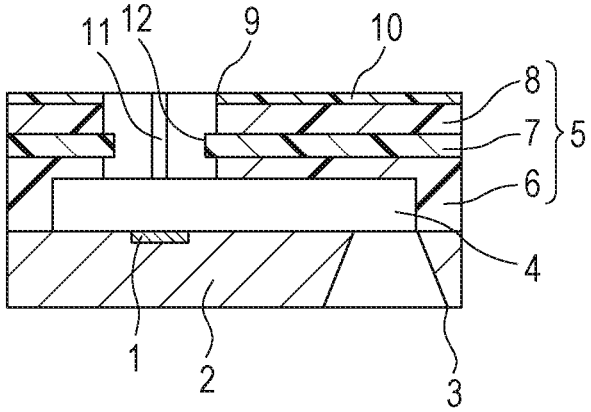

FIG. 1B is a schematic sectional view of the inkjet recording head taken along line IB-IB in FIG. 1A. The inkjet recording head illustrated in FIGS. 1A and 1B includes a substrate 2 in which energy generating elements 1, which generate energy used for ejecting ink, are formed at a predetermined pitch. In the substrate 2, a supply passage 3, which supplies ink, is formed so as to extend through the substrate 2. On the substrate 2, an ejection orifice-forming member 5 is formed, which forms a channel 4 for ink and ejection orifices 9 for ink. The ejection orifice-forming member 5 includes an ejection orifice-forming member layer A 6, an intermediate water-repellent layer 7, and an ejection orifice-forming member layer B 8. Within each ejection orifice 9, protrusions 11 are formed so as to protrude into the ejection orifice 9. Incidentally, the phrase "protrude into the ejection orifice 9" means protrusion in a direction toward the center line extending in the ejection direction of ink (liquid) in the ejection orifice 9. In addition to the protrusions 11, a water-repellent projection portion 12 is formed, which is at least a portion of the intermediate water-repellent layer 7 and projects farther into the ejection orifice 9 than the ejection orifice-forming member layer A 6 and the ejection orifice-forming member layer B 8. Incidentally, the phrase "project into the ejection orifice 9" means projection in a direction toward the center line extending in the ejection direction of ink (liquid) in the ejection orifice 9. On a first surface of the ejection orifice-forming member 5, the first surface having the ejection orifice 9 being exposed, a surface water-repellent layer 10 is formed. In the inkjet recording head illustrated in FIGS. 1A and 1B, to ink supplied from the supply passage 3 through the channel 4, energy generated by the energy generating elements 1 is applied, so that the ink is ejected as ink droplets through the ejection orifices 9.

Figure 2A:
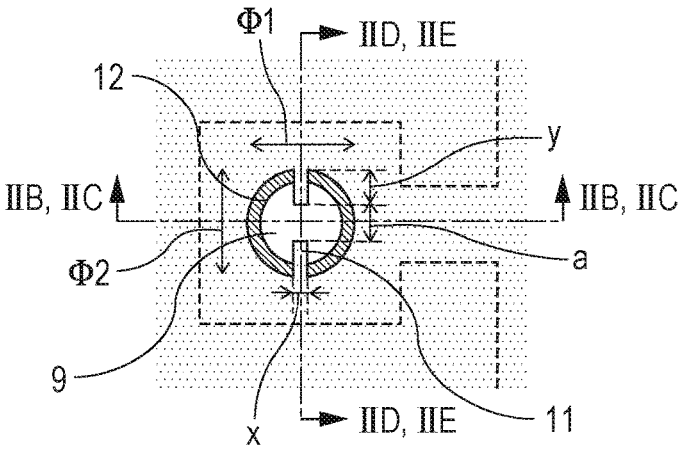
FIGS. 2A to 2E are a top view and sectional views that illustrate a region at and near an ejection orifice of an example of an inkjet recording head according to a first embodiment of the disclosure.
Figure 2B:
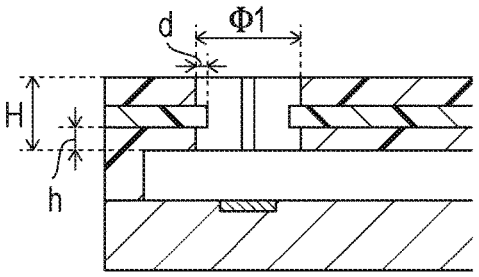
Figure 2C:
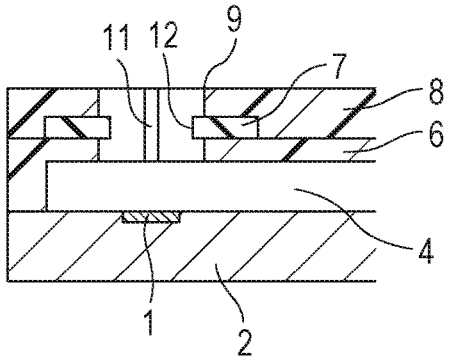
Figure 2D:
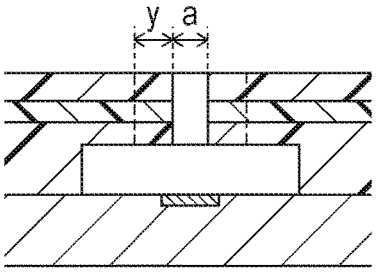
Figure 2E:
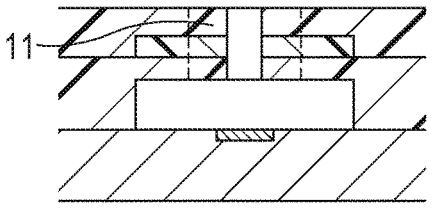

FIG. 2A is a top view that illustrates an example of a region at and near an ejection orifice 9 (viewed from the liquid ejection side) of the inkjet recording head according to this embodiment. FIGS. 2B and 2C are sectional views of the region taken along line IIB, IIC-IIB, IIC in FIG. 2A. FIGS. 2D and 2E are sectional views of the region taken along line IID, IIE-IID, IIE in FIG. 2A. As illustrated in FIGS. 2A to 2E, the inkjet recording head according to this embodiment includes a water-repellent projection portion 12, which is at least a portion of the intermediate water-repellent layer 7 and which projects farther into the ejection orifice 9 by a length d than the ejection orifice-forming member layer A 6 and the ejection orifice-forming member layer B 8. The ejection orifice 9 has a larger diameter Φ1 and a shorter diameter Φ2. The protrusions 11 have a width x, a length y, and a gap width a. The smaller the gap width a, the smaller the amount of satellite droplets and mist, but the higher the forward resistance within the ejection orifice 9. On the other hand, a decrease in the width x results in a decrease in the forward resistance; however, this results in a decrease in the strength of the protrusions 11, and degradation of the durability.

Figure 3A:
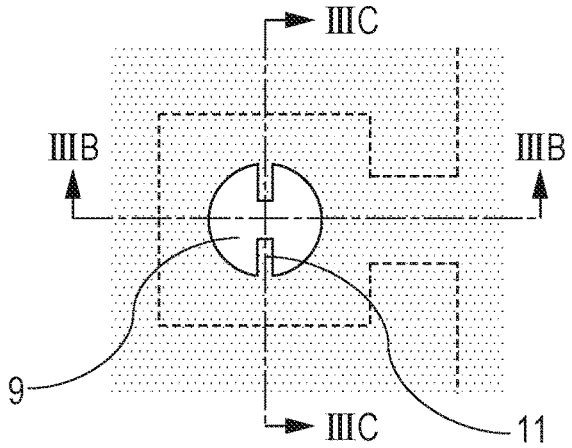
FIGS. 3A to 3C are a top view and sectional views that illustrate a region at and near an ejection orifice of an example of an inkjet recording head in the related art.
Figure 3B:
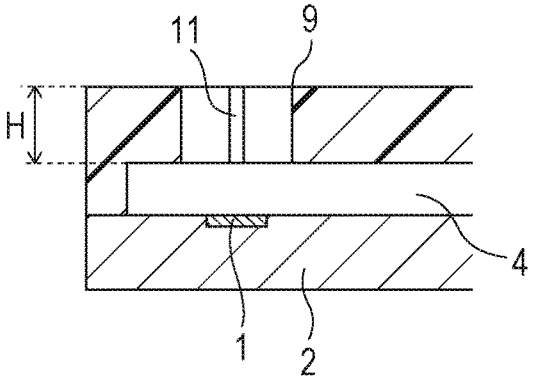
Figure 3C:
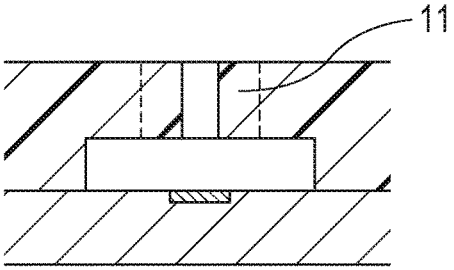

For comparison, provided in FIG. 3A is a top view of an example of a region at and near an ejection orifice 9 of an inkjet recording head in the related art. FIG. 3B is a sectional view of the region taken along line IIIB-IIIB in FIG. 3A. FIG. 3C is a sectional view of the region taken along line IIIC-IIIC in FIG. 3A. In the inkjet recording head illustrated in FIGS. 3A to 3C in the related art, the meniscus of liquid is positioned at the first surface of the ejection orifice-forming member, the first surface having the ejection orifice 9 being exposed. Thus, in order to decrease the forward resistance within the ejection orifice 9, it is necessary to decrease a thickness H of the ejection orifice-forming member over the channel 4. However, a decrease in the thickness H of the ejection orifice-forming member over the channel 4 results in a decrease in the strength of the ejection orifice-forming member. This may result in deformation of the ejection orifice 9 and the ejection orifice-forming member, or breakage in the region at and near the ejection orifice 9 due to an action of applying an external force to the ejection orifice 9, such as wiping. In this case, ink droplets ejected may have variations in the ejection direction, or the amount of ink droplets ejected may vary. This may result in unevenness in the output image.

Figure 4A:
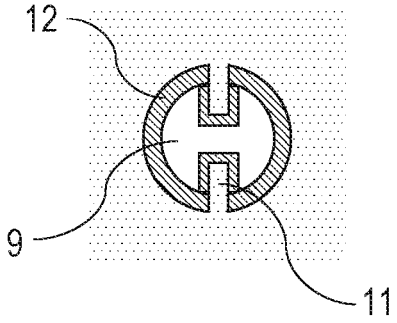
FIGS. 4A to 4C are top views that illustrate examples of the shape of an ejection orifice of an inkjet recording head according to a first embodiment of the disclosure.
Figure 4B:
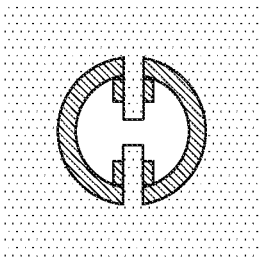
Figure 4C:
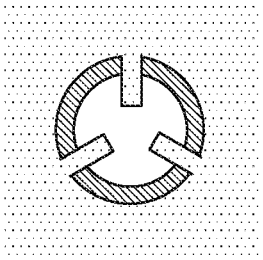

By contrast, as illustrated in FIGS. 2A to 2E, the inkjet recording head according to this embodiment includes the water-repellent projection portion 12 within the ejection orifice 9, so that the meniscus is positioned at the water-repellent projection portion 12 within the ejection orifice 9. For this reason, in this embodiment, without decreasing the thickness H of the ejection orifice-forming member over the channel 4, in other words, without causing a decrease in the strength of the ejection orifice-forming member, a decrease in the forward resistance within the ejection orifice 9 can be achieved. As illustrated in FIGS. 2B and 2C, in this embodiment, the forward resistance within the ejection orifice 9 depends not on the thickness H of the ejection orifice-forming member over the channel 4, but on the thickness h of the ejection orifice-forming member layer A 6 over the channel 4. Accordingly, the intermediate water-repellent layer 7 does not affect the position of the meniscus in both of the following cases: in a case where, as illustrated in FIGS. 2B and 2D, the intermediate water-repellent layer 7 is formed so as to cover the whole surface of the ejection orifice-forming member layer A 6; and, in a case where, as illustrated in FIGS. 2C and 2E, the intermediate water-repellent layer 7 is patterned so as to cover an area of the surface of the ejection orifice-forming member layer A 6. Incidentally, the shape of the ejection orifice 9 according to this embodiment is not limited to that is illustrated in FIG. 2A, and may be appropriately selected from, for example, the shapes illustrated in FIGS. 4A to 4C. The horizontal sectional shape of the ejection orifice 9 other than the protrusions 11 is not limited to circular arcs.

In this embodiment, the protrusions 11 and the water-repellent projection portion 12 are formed within the ejection orifice. However, the protrusions 11 are protrusion portions that are not the same as and are different from the water-repellent projection portion 12. For example, the water-repellent projection portion 12 may be formed on the area (not the protrusions 11) of the inner wall of the ejection orifice 9, and may be further formed on the surfaces of the protrusions 11. For example, in FIGS. 2A to 2E, the water-repellent projection portion 12 is formed on the area (not the protrusions 11) of the inner wall of the ejection orifice 9.

Each protrusion 11 may be constituted by the intermediate water-repellent layer 7 and the ejection orifice-forming member layer B 8. Alternatively, the protrusion 11 may be constituted by the ejection orifice-forming member layer A 6 and the intermediate water-repellent layer 7. Alternatively, the protrusion 11 may be constituted by the ejection orifice-forming member layer A 6, the intermediate water-repellent layer 7, and the ejection orifice-forming member layer B 8. The length (in the depth direction of the ejection orifice 9) of the protrusion 11 is not particularly limited, and may be 4 to 30 μm.

A static contact angle $\theta_s$ of the water-repellent projection portion 12 for pure water, a static contact angle $\theta_A$ of the ejection orifice-forming member layer A 6 for pure water, and a static contact angle $\theta_B$ of the ejection orifice-forming member layer B 8 for pure water preferably satisfy $\theta_s>\theta_A$ and $\theta_s>\theta_B$. This is because, when $\theta_s>\theta_A$ and $\theta_s>\theta_B$ are satisfied, the meniscus of the liquid is easily maintained at the position of the water-repellent projection portion 12. $\theta_s$ is preferably 10° or more larger than $\theta_A$ and $\theta_B$, more preferably, 20° or more larger than $\theta_A$ and $\theta_B$.

From the viewpoint of easily maintaining the meniscus of the liquid at the position of the water-repellent projection portion 12, $\theta_s$ preferably satisfies $\theta_s>70°$, more preferably $\theta_s>80°$, still more preferably $\theta_s>90°$. The upper limit of $\theta_s$ is not particularly limited; however, for example, $\theta_s$ satisfies $\theta_s\leq 120°$. The ranges of $\theta_A$ and $\theta_B$ are not particularly limited; for example, $\theta_A$ and $\theta_B$ can satisfy $5°\leq\theta_A\leq 70°$ and $10°\leq\theta_B\leq 70°$. Incidentally, $\theta_s$, $\theta_A$, and $\theta_B$ are measured with a contact angle meter CA-X150 (trade name, manufactured by Kyowa Interface Science Co., Ltd.) by measuring the contact angle of a 10 μl pure water droplet.

The ejection orifice-forming member layer A 6 and the ejection orifice-forming member layer B 8 are required to have mechanical strength, resistance to liquid such as ink, and adhesion to underlying components, and also have resolution of photolithographic materials. In order to satisfy the conditions of these properties, at least one of the ejection orifice-forming member layer A 6 and the ejection orifice-forming member layer B 8 can be formed of a cured product of a composition containing a cationically polymerizable resin having two or more epoxy groups, and a photoacid generating agent that generates acid upon absorption of light. When the cationically polymerizable resin having two or more epoxy groups is used, the resultant cured product has a three-dimensional cross-linking, so that the above-described properties tend to be provided. Examples of the cationically polymerizable resin having two or more epoxy groups include epoxy resins such as bisphenol epoxy resins, phenol-novolac epoxy resins, cresol-novolac epoxy resins, and polyfunctional epoxy resins having an oxycyclohexane skeleton. Examples of the corresponding commercially available products include "CELLOXIDE 2021" and "EHPE3150" (all are trade names, manufactured by Daicel Corporation); "157S70" and "jER1031S" (all are trade names, manufactured by Mitsubishi Chemical Corporation); and "EPICLON N-695", "EPICLON N-865", and "EPICLON HP-7200" (all are trade names, manufactured by DIC Corporation). These resins may be used alone or in combination of two or more thereof.

Examples of the photoacid generating agent include sulfonic acid compounds, diazomethane compounds, sulfonium salt compounds, iodonium salt compounds, and disulfone compounds. Examples of the corresponding commercially available products include "ADEKA OPTOMER SP-170", "ADEKA OPTOMER SP-172", and "ADEKA OPTOMER SP-150" (all are trade names, manufactured by ADEKA CORPORATION); "BBI-103" and "BBI-102" (all are trade names, manufactured by Midori Kagaku Co., Ltd.); "IBPF", "IBCF", "TS-01", and "TS-91" (all are trade names, manufactured by SANWA Chemical Co., Ltd.); "CPI-210", "CPI-300", "CPI-410" and "CPI-410S" (all are trade names, manufactured by San-Apro Ltd.); and "Irgacure290" (trade name, manufactured by BASF). These agents may be used alone or in combination of two or more thereof.

For the purpose of improving properties such as photolithographic performance and adhesion performance, the above-described composition may further contain a silane coupling agent; a photosensitizer such as an anthracene derivative; a basic substance such as an amine; and an acid generating agent that generates toluenesulfonic acid, which is weakly acidic (pKa=−1.5 to 3.0). Examples of commercially available products of the acid generating agent that generates toluenesulfonic acid include "TPS-1000" (trade name, manufactured by Midori Kagaku Co., Ltd.) and "WPAG-367" (trade name, manufactured by Wako Pure Chemical Industries, Ltd.). These agents may be used alone or in combination of two or more thereof. Examples of the above-described composition include commercially available negative resists such as "SU-8 series" (trade name, manufactured by Nippon Kayaku Co., Ltd.); and "TMMR S2000" and "TMMFS2000" (all are trade names, manufactured by TOKYO OHKA KOGYO CO., LTD.). Incidentally, in general, the cured product of the composition has a static contact angle for pure water of about 60°.

The intermediate water-repellent layer 7 can be formed of a cured product of a composition containing a condensate of a hydrolyzable silane compound having an epoxy group and a hydrolyzable silane compound having a perfluoropolyether group or a perfluoroalkyl group, a cationically polymerizable resin having two or more epoxy groups, and a photoacid generating agent that generates acid upon absorption of light. When such a composition containing a condensate of a hydrolyzable silane compound having a perfluoropolyether group or a perfluoroalkyl group is used, baking treatment causes such fluorine-containing groups to segregate at the interface between the composition and the air. As a result, the cured product tends to have a static contact angle for pure water of 70° or more, and $\theta_s>\theta_A$ and $\theta_s>\theta_B$ can be easily satisfied. Examples of the hydrolyzable silane compound having an epoxy group include γ-glycidoxypropyltriethoxysilane, γ-glycidoxypropyltrimethoxysilane, and β-(3,4-epoxycyclohexyl)ethyltrimethoxysilane. These compounds may be used alone or in combination of two or more thereof. Examples of the hydrolyzable silane compound having a perfluoropolyether group include compounds represented by the following Formulas (1) to (4).

(1)

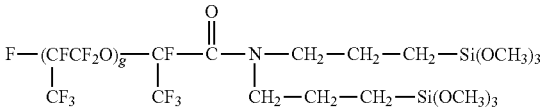

(2)

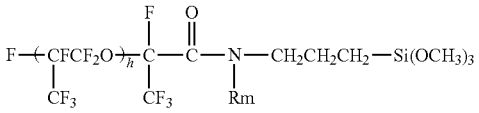

(3)

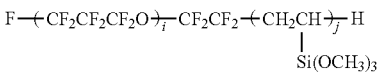

(4)

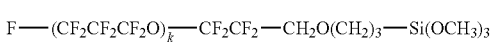

In Formula (1) above, g is 1 to 30. In Formula (2) above, Rm represents a methyl group or a hydrogen atom; and h is 1 to 30. In Formula (3) above, i is 1 to 30, and j is 1 to 4. In Formula (4) above, k is 1 to 30. These compounds may be used alone or in combination of two or more thereof. The cationically polymerizable resin having two or more epoxy groups and the photoacid generating agent may be the same compounds as in the ejection orifice-forming member layer A 6 and the ejection orifice-forming member layer B 8.

In the inkjet recording head according to this embodiment, as illustrated in FIG. 1B, the surface water-repellent layer 10 can be formed on the first surface of the ejection orifice-forming member 5, the first surface having the ejection orifice 9 being exposed, from the viewpoint of prevention of adhesion of dust such as paper lint and ease of removal of adhering dust. Examples of the material of the surface water-repellent layer 10 include cationically polymerizable perfluoroalkyl compositions and perfluoropolyether compositions. Specifically, examples of the material include those disclosed in PCT Japanese Translation Patent Publication No. 2007-518587, such as a condensate of a hydrolyzable silane compound having a fluorine-containing group and a hydrolyzable silane compound having a cationically polymerizable group.

The channel 4 is not particularly limited in terms of height; however, the height can be 3 to 20 μm. The ejection orifice-forming member layer A 6 over the channel 4 may have a thickness h that is preferably ⅔ or less of, more preferably ⅓ or less of the thickness H of the ejection orifice-forming member 5 over the channel 4. The intermediate water-repellent layer 7 preferably has a thickness of 0.3 μm or more, more preferably 1 to 3 μm. The ejection orifice-forming member layer B 8 on the intermediate water-repellent layer 7 is not particularly limited in terms of thickness; however, the thickness can be 2 μm or more. The ejection orifice-forming member 5 over the channel 4 is not particularly limited in terms of thickness H; however, the thickness H can be 4 to 30 μm. When the ejection orifice 9 has a circular shape, the larger diameter Φ1 is not particularly limited and can be 10 to 30 μm. The shorter diameter Φ2 is not particularly limited and can be 10 to 30 μm. The width x of the protrusion 11 is not particularly limited, and can be 1.5 to 5 μm. The length y of the protrusion 11 is not particularly limited, and can be ⅙ or more of the shorter diameter Φ2. When plural protrusions 11 are formed, the gap width a of the protrusions 11 is not particularly limited, and can be 1 to 15 μm. The projection length d of the water-repellent projection portion 12 is preferably 0.1 to 3 μm, more preferably 0.5 to 1.5 μm.

Method for Producing Liquid Ejection Head

Some examples of a method for producing a liquid ejection head according to this embodiment, the following first to third production methods, will be described. Incidentally, inkjet recording heads, which are examples of liquid ejection heads, will be described as examples to which the disclosure is applicable. However, the scope to which a method for producing a liquid ejection head according to the disclosure is applicable is not limited to inkjet recording heads.

(1) First Production Method

A method for producing a liquid ejection head according to this embodiment includes a step of forming, on a substrate, a shape member used for forming a liquid channel and formed of a channel-forming resin composition; a step of forming, on the shape member and the substrate, a layer that is formed of a photosensitive resin composition A and that is curable into an ejection orifice-forming member layer A; a step of forming, on the layer formed of the photosensitive resin composition A, a layer that is formed of a photosensitive resin composition C and that is curable into an intermediate water-repellent layer; a step of forming, on the layer formed of the photosensitive resin composition C, a layer that is formed of a photosensitive resin composition B and that is curable into an ejection orifice-forming member layer B; a step of exposing the layer formed of the photosensitive resin composition A, the layer formed of the photosensitive resin composition C, and the layer formed of the photosensitive resin composition B, to form a pattern of an ejection orifice for ejecting liquid, a protrusion protruding into the ejection orifice, and a water-repellent projection portion; a step of removing unexposed regions from the layer formed of the photosensitive resin composition A, the layer formed of the photosensitive resin composition C, and the layer formed of the photosensitive resin composition B; and a step of removing the shape member. The water-repellent projection portion is at least a portion of the intermediate water-repellent layer, and projects farther into the ejection orifice than the ejection orifice-forming member layer A and the ejection orifice-forming member layer B. According to this method, the liquid ejection head according to this embodiment can be efficiently produced with high accuracy.

FIGS. 5A to 5G are schematic sectional views that illustrate steps in the method for producing an inkjet recording head that is an example of this embodiment. These schematic sectional views are sectional views taken along line IIB, IIC-IIB, IIC in FIG. 2A. The same applies to FIGS. 6A to 6G and FIGS. 7A to 7J.

Figure 5A:
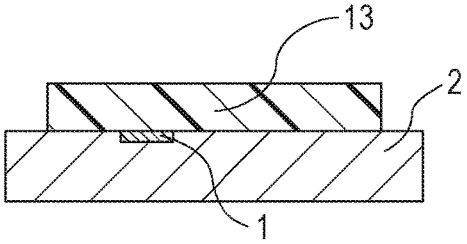
FIGS. 5A to 5G are sectional views that illustrate an example of a method for producing an inkjet recording head according to a first embodiment of the disclosure.

As illustrated in FIG. 5A, on a substrate 2 in which energy generating elements 1 are disposed, a shape member 13 used for forming a liquid channel and formed of a channel-forming resin composition is first formed. For example, on the substrate 2 in which the energy generating elements 1 are disposed, a layer formed of the channel-forming resin composition is formed and then exposed through a channel pattern mask, and the exposed regions are dissolved and removed to thereby form the shape member 13. The channel-forming resin composition is not particularly limited as long as it can be removed after formation of an ejection orifice-forming member 5. Examples of the composition include compositions that have positive photolithographic performance and are decomposed with Deep-UV to become soluble in organic solvents, such as polymethacrylate positive resists and polyacrylate positive resists. In particular, polymethyl isopropenyl ketone can be used. For polymethyl isopropenyl ketone, an example of a commercially available product is ODUR-1010 (trade name, manufactured by TOKYO OHKA KOGYO CO., LTD.).

Figure 5B:
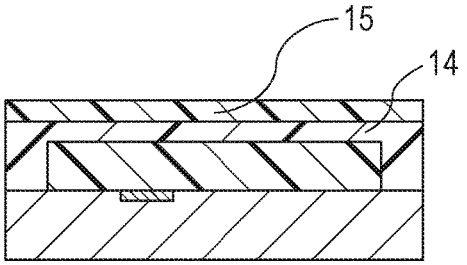

Subsequently, as illustrated in FIG. 5B, on the shape member 13 and the substrate 2, a layer 14 formed of the photosensitive resin composition A and a layer 15 formed of the photosensitive resin composition C are formed in this order. The layer 14 formed of the photosensitive resin composition A is a layer that is curable into an ejection orifice-forming member layer A 6. The layer 15 formed of the photosensitive resin composition C is a layer that is curable into an intermediate water-repellent layer 7. As described above, the photosensitive resin composition A can contain a cationically polymerizable resin having two or more epoxy groups, and a photoacid generating agent that generates acid upon absorption of light. As described above, the photosensitive resin composition C can contain a condensate of a hydrolyzable silane compound having an epoxy group and a hydrolyzable silane compound having a perfluoropolyether group or a perfluoroalkyl group, a cationically polymerizable resin having two or more epoxy groups, and a photoacid generating agent that generates acid upon absorption of light. The layer 14 formed of the photosensitive resin composition A and the layer 15 formed of the photosensitive resin composition C may be formed by the following method, for example: the photosensitive resin compositions containing solvents are applied by spin coating or slit coating, and the solvents are then evaporated by a baking step. Alternatively, a lamination method may be employed: the layers are temporarily formed on a film substrate formed of, for example, PET (polyethylene terephthalate) or polyimide, and the layers are subsequently transferred. Such formation methods can be appropriately selected in accordance with the type of resin materials and the type of solvents.

Figure 5C:
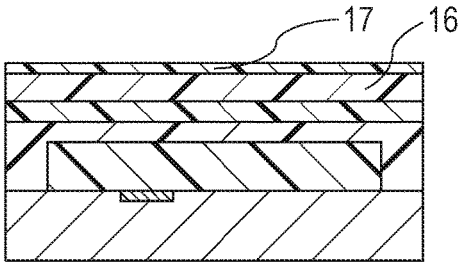

Subsequently, as illustrated in FIG. 5C, on the layer 15 formed of the photosensitive resin composition C, a layer 16 formed of the photosensitive resin composition B and a layer 17 formed of a photosensitive resin composition D are formed in this order. The layer 16 formed of the photosensitive resin composition B is a layer that is curable into an ejection orifice-forming member layer B 8. The layer 17 formed of the photosensitive resin composition D is a layer that is curable into a surface water-repellent layer 10. As described above, the photosensitive resin composition B can contain a cationically polymerizable resin having two or more epoxy groups, and a photoacid generating agent that generates acid upon absorption of light. The photosensitive resin composition D can contain the above-described material of the surface water-repellent layer 10. Incidentally, in the steps illustrated in FIGS. 5A to 5G, the surface water-repellent layer 10 is formed; however, the formation of the surface water-repellent layer 10 is optional.

Figure 5D:
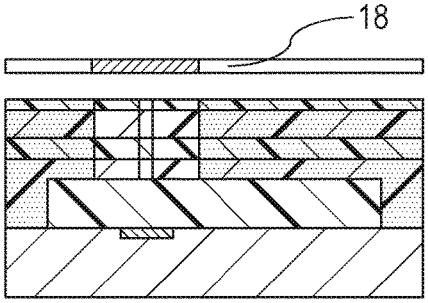

Subsequently, as illustrated in FIG. 5D, the layer 14 formed of the photosensitive resin composition A, the layer 15 formed of the photosensitive resin composition C, the layer 16 formed of the photosensitive resin composition B, and the layer 17 formed of the photosensitive resin composition D are exposed through an ejection orifice pattern mask 18. As a result, a pattern of ejection orifices 9 and protrusions 11, which protrude into the ejection orifices 9, is formed. The ejection orifice pattern mask 18 may be a mask including a substrate formed of a material that transmits light at the exposure wavelength, such as glass or quartz, and a light-shielding film (such as a chromium film) formed on the substrate so as to correspond to the pattern. The same applies to other masks described later. Examples of the exposure system include projection aligners that employ a single-wavelength light source such as i-line exposure steppers and KrF steppers, or that employ a mercury lamp as a light source such as a mask aligner MPA-600Super (trade name, manufactured by CANON KABUSHIKI KAISHA). A broad-wavelength exposure system may be used in combination with a filter that transmits light at a specific wavelength. The same applies to other exposure processes described later. In this step, the exposure dose, which may be determined in accordance with the materials of the photosensitive resin compositions, may be, for example, 500 to 20000 J/m$^2$.

Figure 5E:
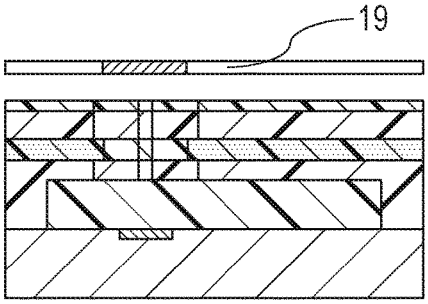

Subsequently, as illustrated in FIG. 5E, the layer 15 formed of the photosensitive resin composition C is exposed through a water-repellent projection portion pattern mask 19, to form a pattern of the water-repellent projection portions 12. The photosensitive resin composition A, the photosensitive resin composition B, and the photosensitive resin composition C are selected so as to have different sensitivities. In the exposure through the water-repellent projection portion pattern mask 19, an exposure dose that causes curing of only the photosensitive resin composition C is selected, to thereby form the water-repellent projection portions 12. Specifically, the curing exposure doses for the photosensitive resin composition A, the photosensitive resin composition B, and the photosensitive resin composition C are respectively represented by Eth1, Eth2, and Eth3. When an exposure dose E satisfies Eth1>E>Eth3 and Eth2>E>Eth3, the photosensitive resin composition C alone can be cured. Thus, Eth1>Eth3 and Eth2>Eth3 can be satisfied. Incidentally, such a curing exposure dose denotes a minimum exposure dose E=Eth at which a negative photosensitive resin composition becomes insoluble in the solvent used for dissolving and removing the composition, in other words, the photosensitive resin composition remains as residue during development and cannot be removed. The curing exposure doses for the photosensitive resin compositions can be adjusted by, for example, changing the type or addition amount of the above-described photoacid generating agent, basic substance, acid generating agent, or photosensitizer. The same effect as in providing different sensitivities among photosensitive resin compositions can be expected by preparing photosensitive resin compositions having different sensitive wavelengths through selection of different photoacid generating agents and different photosensitizers, and by using different exposure wavelengths for the photosensitive resin compositions. In this step, the exposure dose, which may be selected in accordance with the materials of the photosensitive resin compositions, may be, for example, 500 to 20000 J/m$^2$.

Figure 5F:
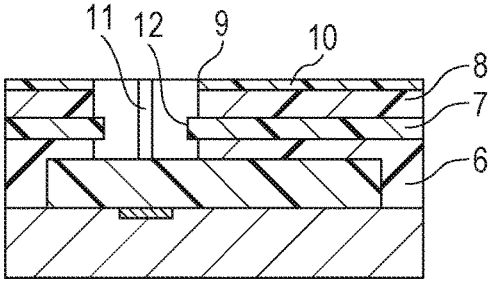

Subsequently, as illustrated in FIG. 5F, the unexposed regions are removed from the layer 14 formed of the photosensitive resin composition A, the layer 15 formed of the photosensitive resin composition C, the layer 16 formed of the photosensitive resin composition B, and the layer 17 formed of the photosensitive resin composition D. For example, the exposed regions are first cured by heat treatment (Post Exposure Bake). After that, the uncured regions can be removed with a solvent from the layer 14 formed of the photosensitive resin composition A, the layer 15 formed of the photosensitive resin composition C, the layer 16 formed of the photosensitive resin composition B, and the layer 17 formed of the photosensitive resin composition D. The solvent, which may be selected in accordance with the materials of the photosensitive resin compositions, may be, for example, propylene glycol monomethyl ether acetate (PGMEA), or methyl isobutyl ketone (MIBK). As a result, the following are formed: the ejection orifice-forming member layer A 6, the intermediate water-repellent layer 7, the ejection orifice-forming member layer B 8, the ejection orifices 9, the surface water-repellent layer 10, the protrusions 11, and the water-repellent projection portions 12.

Figure 5G:
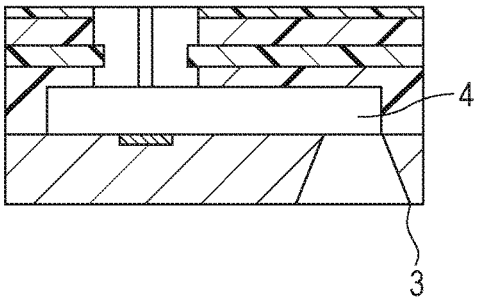

Subsequently, as illustrated in FIG. 5G, a liquid supply passage 3 is formed in the substrate 2, and the shape member 13 is removed. For example, after the ejection orifice-forming member on the substrate 2 is protected with a rubber film, an alkaline etchant may be used to form the supply passage 3 in the substrate 2. In addition, after the removal of the rubber film, the shape member 13 is dissolved and removed with a solvent to thereby form the channel 4. The solvent, which may be selected in accordance with the material of the shape member 13, may be, for example, methyl lactate. Incidentally, when the shape member 13 is formed of a positive resist, it may be irradiated with ultraviolet rays to enhance the solubility. In the step illustrated in FIG. 5A, when a lamination process is employed to form the shape member 13, at the time of the step illustrated in FIG. 5A, a substrate 2 in which a supply passage 3 has been formed can be used.

The method according to this embodiment can further include a step of performing heating at 90° C. or more and 250° C. or less after the step of removing the unexposed regions from the layer 14 formed of the photosensitive resin composition A, the layer 15 formed of the photosensitive resin composition C, the layer 16 formed of the photosensitive resin composition B, and optionally the layer 17 formed of the photosensitive resin composition D. The heating temperature is more preferably 120° C. or more and 240° C. or less, still more preferably 150° C. or more and 220° C. or less. When the heating temperature is 90° C. or more, the fluorine-containing groups of the water-repellent projection portion 12 can be made to sufficiently segregate at the interface between the water-repellent projection portion 12 and the air, to thereby sufficiently decrease the surface energy, compared with the ejection orifice-forming member layer A 6 and the ejection orifice-forming member layer B 8. As a result, the meniscus of the liquid can be easily maintained at the position of the water-repellent projection portion 12. In addition, when the heating temperature is 250° C. or less, degradation of the durability of the ejection orifice-forming member due to decomposition of the resin can be sufficiently prevented. Incidentally, the heating step may be performed after the step of removing the shape member 13.

After that, electrical connections are established, and an ink supply unit is appropriately disposed to thereby provide an inkjet recording head.

(2) Second Production Method

A method for producing a liquid ejection head according to this embodiment includes a step of forming, on a substrate, a shape member used for forming a liquid channel and formed of a channel-forming resin composition; a step of forming, on the shape member and the substrate, a layer that is formed of a photosensitive resin composition A and that is curable into an ejection orifice-forming member layer A; a step of exposing the layer formed of the photosensitive resin composition A, to form a pattern of an ejection orifice for ejecting liquid; a step of forming, on the layer formed of the photosensitive resin composition A, a layer that is formed of a photosensitive resin composition C and that is curable into an intermediate water-repellent layer; a step of exposing the layer formed of the photosensitive resin composition C to form a pattern of the ejection orifice, a protrusion protruding into the ejection orifice, and a water-repellent projection portion; a step of removing unexposed regions from the layer formed of the photosensitive resin composition A and the layer formed of the photosensitive resin composition C; a step of forming, on the intermediate water-repellent layer, a layer that is formed of a photosensitive resin composition B and that is curable into an ejection orifice-forming member layer B; a step of exposing the layer formed of the photosensitive resin composition B, to form a pattern of the ejection orifice and the protrusion; a step of removing unexposed regions from the layer formed of the photosensitive resin composition B; and a step of removing the shape member. The water-repellent projection portion is at least a portion of the intermediate water-repellent layer, and projects farther into the ejection orifice than the ejection orifice-forming member layer A and the ejection orifice-forming member layer B. According to this method, the liquid ejection head according to this embodiment can be efficiently produced with high accuracy.

FIGS. 6A to 6G are schematic sectional views that illustrate steps in the method for producing an inkjet recording head that is an example of this embodiment. Incidentally, in the steps illustrated in FIGS. 6A to 6G, formation of the surface water-repellent layer 10 is omitted. However, as in the above-described production method illustrated in FIGS. 5A to 5G, the surface water-repellent layer 10 may be formed.

Figure 6A:
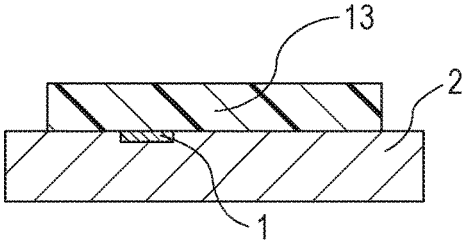
FIGS. 6A to 6G are sectional views that illustrate an example of a method for producing an inkjet recording head according to a first embodiment of the disclosure.

As illustrated in FIG. 6A, on a substrate 2 in which energy generating elements 1 are disposed, a shape member 13 used for forming a liquid channel and formed of a channel-forming resin composition is first formed. The shape member 13 can be formed in the same manner as in the first embodiment.

Figure 6B:
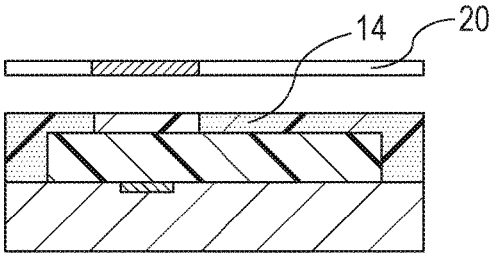

Subsequently, as illustrated in FIG. 6B, on the shape member 13 and the substrate 2, a layer 14 formed of the photosensitive resin composition A is formed, and exposed through an ejection orifice pattern mask 20, to form a pattern of ejection orifices 9. The formation of the layer 14 formed of the photosensitive resin composition A and the exposure through the ejection orifice pattern mask 20 can be performed in the same manner as in the first embodiment. After the exposure, heat treatment may be performed to cure the exposed regions.

Figure 6C:
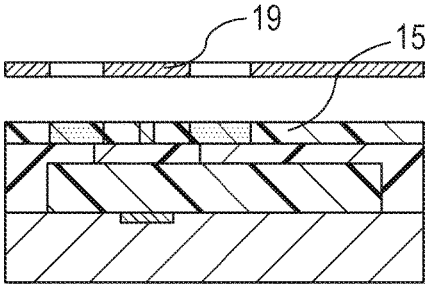

Subsequently, as illustrated in FIG. 6C, on the layer 14 formed of the photosensitive resin composition A, a layer 15 formed of the photosensitive resin composition C is formed, and exposed through a water-repellent projection portion pattern mask 19. As a result, in the layer 15 formed of the photosensitive resin composition C, a pattern of the ejection orifices 9, protrusions 11, which protrude into the ejection orifices 9, and the water-repellent projection portions 12 is formed. The photosensitive resin composition A and the photosensitive resin composition C are selected so as to have different sensitivities. In the exposure through the water-repellent projection portion pattern mask 19, an exposure dose that causes curing of only the photosensitive resin composition C is selected, to thereby form the water-repellent projection portions 12. Specifically, the curing exposure doses of the photosensitive resin composition A and the photosensitive resin composition C are respectively represented by Eth1 and Eth3. When an exposure dose E satisfies Eth1>E >Eth3, the photosensitive resin composition C alone can be cured. Thus, Eth1>Eth3 can be satisfied. The formation of the layer 15 formed of the photosensitive resin composition C and the exposure through the water-repellent projection portion pattern mask 19 can be performed in the same manner as in the first embodiment. After the exposure, heat treatment may be performed to cure the exposed regions.

Figure 6D:
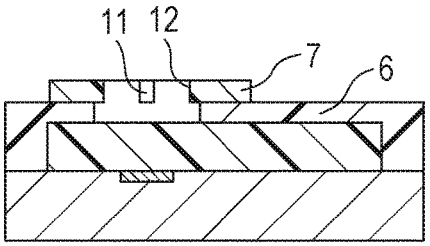

Subsequently, as illustrated in FIG. 6D, the unexposed regions are removed from the layer 14 formed of the photosensitive resin composition A and the layer 15 formed of the photosensitive resin composition C. The unexposed regions can be removed with a solvent. The solvent, which may be selected in accordance with the materials of the photosensitive resin compositions, may be, for example, PGMEA or MIBK. As a result, the following are formed: the ejection orifice-forming member layer A 6, the intermediate water-repellent layer 7, portions of the protrusions 11, and the water-repellent projection portions 12.

Figure 6E:
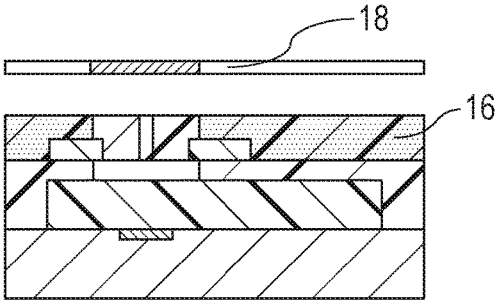

Subsequently, as illustrated in FIG. 6E, on the intermediate water-repellent layer 7 and the ejection orifice-forming member layer A 6, a layer 16 formed of the photosensitive resin composition B is formed and exposed through an ejection orifice pattern mask 18, to form a pattern of the ejection orifices 9 and the protrusions 11. The layer 16 formed of the photosensitive resin composition B can be formed by a lamination process. The exposure through the ejection orifice pattern mask 18 can be performed in the same manner as in the first embodiment. After the exposure, heat treatment may be performed to cure the exposed regions.

Figure 6F:
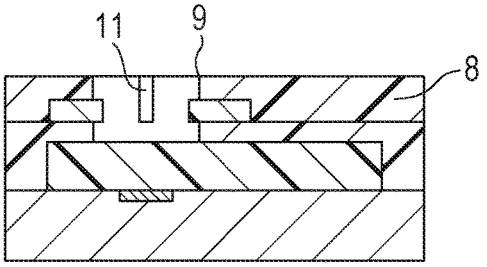

Subsequently, as illustrated in FIG. 6F, the unexposed regions are removed from the layer 16 formed of the photosensitive resin composition B. The removal of the unexposed regions can be performed with a solvent. The solvent, which may be selected in accordance with the material of the photosensitive resin composition B, may be, for example, PGMEA or MIBK. As a result, the following are formed: the ejection orifice-forming member layer B 8, the ejection orifices 9, and the protrusions 11.

Figure 6G:
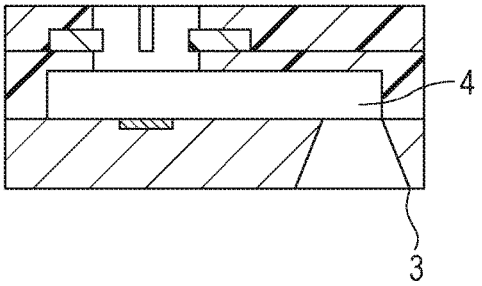

Subsequently, as illustrated in FIG. 6G, a liquid supply passage 3 is formed in the substrate 2. The shape member 13 is removed to form a liquid channel 4. The formation of the supply passage 3 and the removal of the shape member 13 can be performed in the same manner as in the first embodiment. Incidentally, in the step illustrated in FIG. 6A, when a lamination process is employed for forming the shape member 13, at the time of the step illustrated in FIG. 6A, a substrate 2 in which a supply passage 3 has been formed can be used.

As in the first embodiment, the method according to this embodiment can further include a step of performing heating at 90° C. or more and 250° C. or less after the step of removing the unexposed regions from the layer 16 formed of the photosensitive resin composition B. Incidentally, the heating step may be performed after the step of removing the shape member 13.

After that, electrical connections are established, and an ink supply unit is appropriately disposed to thereby provide an inkjet recording head.

(3) Third Production Method

A method for producing a liquid ejection head according to this embodiment includes a step of forming, on a substrate, a layer that is formed of a photosensitive resin composition E and that is curable into a channel-forming member; a step of forming, on the layer formed of the photosensitive resin composition E, a layer that is formed of a photosensitive resin composition A and that is curable into an ejection orifice-forming member layer A; a step of exposing the layer formed of the photosensitive resin composition E, to form a pattern of a liquid channel; a step of exposing the layer formed of the photosensitive resin composition A, to form a pattern of an ejection orifice for ejecting liquid; a step of removing unexposed regions from the layer formed of the photosensitive resin composition E and the layer formed of the photosensitive resin composition A; a step of forming, in the following order, on the ejection orifice-forming member layer A, a layer that is formed of a photosensitive resin composition C and that is curable into an intermediate water-repellent layer, and a layer that is formed of a photosensitive resin composition B and that is curable into an ejection orifice-forming member layer B; a step of exposing the layer formed of the photosensitive resin composition C and the layer formed of the photosensitive resin composition B, to form a pattern of the ejection orifice, a protrusion that protrudes into the ejection orifice, and a water-repellent projection portion; and a step of removing unexposed regions from the layer formed of the photosensitive resin composition C and the layer formed of the photosensitive resin composition B. The water-repellent projection portion is at least a portion of the intermediate water-repellent layer, and projects farther into the ejection orifice than the ejection orifice-forming member layer A and the ejection orifice-forming member layer B. According to this method, the liquid ejection head according to this embodiment can be efficiently produced with high accuracy.

FIGS. 7A to 7J are schematic sectional views that illustrate steps in the method for producing an inkjet recording head that is an example of this embodiment. Incidentally, in the steps illustrated in FIGS. 7A to 7J, the formation of the surface water-repellent layer 10 is omitted. However, as in the above-described production method illustrated in FIGS. 5A to 5G, the surface water-repellent layer 10 may be formed.

Figure 7A:
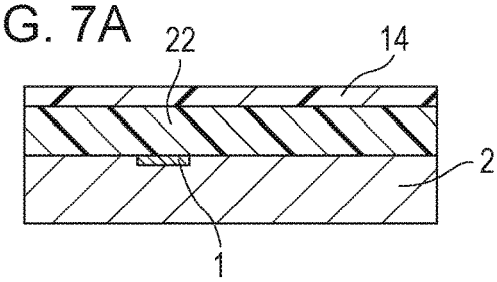
FIGS. 7A to 7J are sectional views that illustrate an example of a method for producing an inkjet recording head according to a first embodiment of the disclosure.

As illustrated in FIG. 7A, on a substrate 2 in which energy generating elements 1 are disposed, a layer 22 formed of the photosensitive resin composition E and a layer 14 formed of the photosensitive resin composition A are first formed in this order. The layer 22 formed of the photosensitive resin composition E is a layer that is curable into a channel-forming member 21. The photosensitive resin composition E can be the same material as the above-described photosensitive resin compositions A and B, and can be a cationically polymerizable epoxy resin composition. The layer 22 formed of the photosensitive resin composition E and the layer 14 formed of the photosensitive resin composition A can be formed in the same manner as in the first embodiment.

Figure 7B:
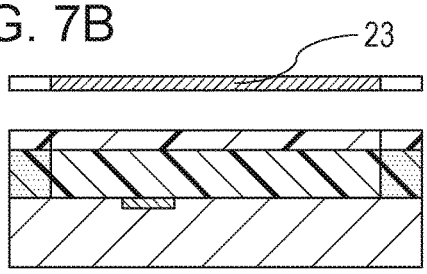

Subsequently, as illustrated in FIG. 7B, the layer 22 formed of the photosensitive resin composition E is exposed through a channel pattern mask 23, to form a pattern of a channel 4 in the layer 22 formed of the photosensitive resin composition E. The exposure through the channel pattern mask 23 can be performed in the same manner as in the first embodiment.

Figure 7C:
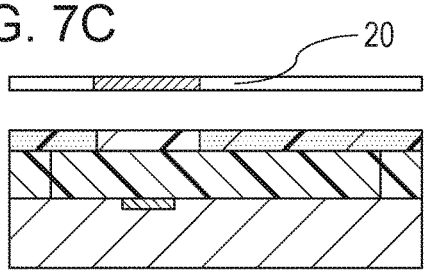

Subsequently, as illustrated in FIG. 7C, the layer 14 formed of the photosensitive resin composition A is exposed through an ejection orifice pattern mask 20, to form a pattern of ejection orifices 9 in the layer 14 formed of the photosensitive resin composition A. The photosensitive resin composition A and the photosensitive resin composition E are selected so as to have different sensitivities. In the exposure through the ejection orifice pattern mask 20, an exposure dose that causes curing of only the photosensitive resin composition A is selected, to form the ejection orifices 9. Specifically, the curing exposure doses of the photosensitive resin composition A and the photosensitive resin composition E are respectively represented by Eth1 and Eth4. When an exposure dose E satisfies $Eth1<E<Eth4$, the photosensitive resin composition A alone can be cured. Thus, $Eth1<Eth4$ can be satisfied. The exposure through the ejection orifice pattern mask 20 can be performed in the same manner as in the first embodiment. After the exposure, heat treatment may be performed to cure the exposed regions.

Figure 7D:
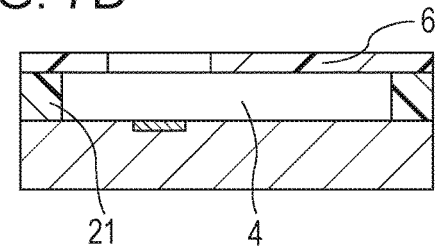

Subsequently, as illustrated in FIG. 7D, the unexposed regions are removed from the layer 22 formed of the photosensitive resin composition E and the layer 14 formed of the photosensitive resin composition A. The unexposed regions can be removed with a solvent. The solvent, which may be selected in accordance with the materials of the photosensitive resin compositions, may be, for example, PGMEA or MIBK. As a result, the following are formed: the channel-forming member 21, the ejection orifice-forming member layer A 6, the channel 4, and portions of the ejection orifices 9.

Figure 7E:
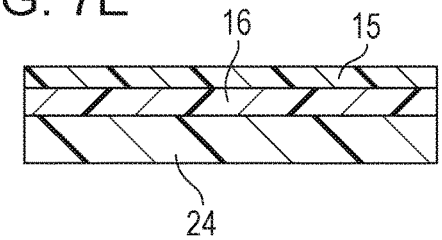

Subsequently, as illustrated in FIG. 7E, on a film substrate 24, a layer 16 formed of the photosensitive resin composition B and a layer 15 formed of the photosensitive resin composition C are formed in this order. The film substrate 24 may be a film substrate formed of, for example, PET or polyimide. The formation of the layer 16 formed of the photosensitive resin composition B and the layer 15 formed of the photosensitive resin composition C can be performed in the same manner as in the first embodiment.

Figure 7F:
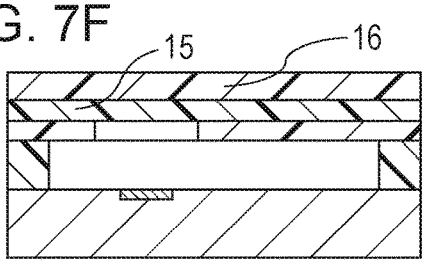

Subsequently, as illustrated in FIG. 7F, a lamination process is performed such that the layer 15 formed of the photosensitive resin composition C and the layer 16 formed of the photosensitive resin composition B on the film substrate 24 are transferred onto the ejection orifice-forming member layer A 6. As a result, on the ejection orifice-forming member layer A 6, the layer 15 formed of the photosensitive resin composition C and the layer 16 formed of the photosensitive resin composition B are formed in this order.

Figure 7G:
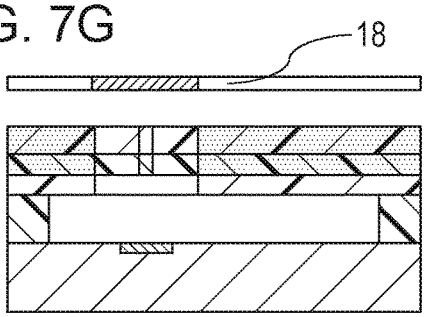

Subsequently, as illustrated in FIG. 7G, the layer 15 formed of the photosensitive resin composition C and the layer 16 formed of the photosensitive resin composition B are exposed through an ejection orifice pattern mask 18. As a result, formed is a pattern of the ejection orifices 9 and protrusions 11, which protrude into the ejection orifices. The exposure through the ejection orifice pattern mask 18 can be performed in the same manner as in the first embodiment.

Figure 7H:
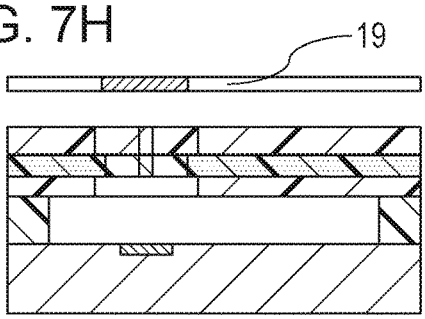

Subsequently, as illustrated in FIG. 7H, the layer 15 formed of the photosensitive resin composition C is exposed through a water-repellent projection portion pattern mask 19, to form a pattern of a water-repellent projection portion 12 in the layer 15 formed of the photosensitive resin composition C. The photosensitive resin composition B and the photosensitive resin composition C are selected so as to have different sensitivities. In the exposure through the water-repellent projection portion pattern mask 19, an exposure dose that causes curing of only the photosensitive resin composition C is selected, to thereby form the water-repellent projection portion 12. Specifically, the curing exposure doses for the photosensitive resin composition B and the photosensitive resin composition C are respectively represented by Eth2 and Eth3. When an exposure dose E satisfies Eth2>E>Eth3, the photosensitive resin composition C alone can be cured. Thus, Eth2>Eth3 can be satisfied. The exposure through the water-repellent projection portion pattern mask 19 can be performed in the same manner as in the first embodiment. After the exposure, heat treatment may be performed to cure the exposed regions.

Figure 7I:
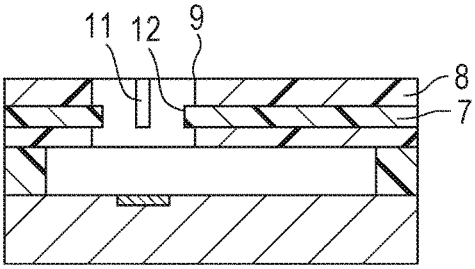

Subsequently, as illustrated in FIG. 7I, the unexposed regions are removed from the layer 15 formed of the photosensitive resin composition C and the layer 16 formed of the photosensitive resin composition B. The unexposed regions can be removed with a solvent. The solvent, which may be selected in accordance with the materials of the photosensitive resin compositions, may be, for example, PGMEA or MIBK. As a result, the following are formed: the intermediate water-repellent layer 7, the ejection orifice-forming member layer B 8, the ejection orifices 9, the protrusions 11, and the water-repellent projection portions 12.

Figure 7J:
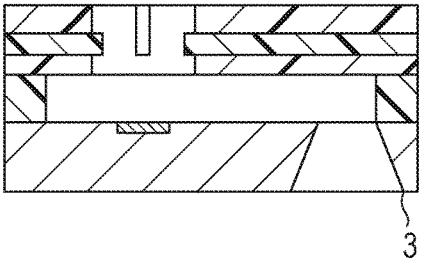

Subsequently, as illustrated in FIG. 7J, a liquid supply passage 3 is formed in the substrate 2. The supply passage 3 can be formed in the same manner as in the first embodiment. Incidentally, in the step illustrated in FIG. 7A, when a lamination process is employed to form the layer 22 formed of the photosensitive resin composition E, at the time of the step illustrated in FIG. 7A, a substrate 2 in which a supply passage 3 has been formed can be used.

As in the first embodiment, the method according to this embodiment can further include a step of performing heating at 90° C. or more and 250° C. or less after the step of removing the unexposed regions from the layer formed of the photosensitive resin composition C and the layer formed of the photosensitive resin composition B.

After that, electrical connections are established, and an ink supply unit is appropriately disposed to thereby provide an inkjet recording head.

Second Example Embodiment

Liquid Ejection Head

A liquid ejection head according to the second embodiment includes a substrate; and an ejection orifice-forming member formed on the substrate and including an ejection orifice configured to eject liquid and a liquid channel communicating with the ejection orifice. The ejection orifice-forming member includes an ejection orifice-forming member layer A, an intermediate water-repellent layer, and an ejection orifice-forming member layer B in this order from a substrate-side of the member. The ejection orifice-forming member includes a protrusion protruding into the ejection orifice. The ejection orifice-forming member includes a water-repellent projection portion that is a portion of the intermediate water-repellent layer, the portion being on the surface of the tip of the protrusion, and that projects farther into the ejection orifice than the ejection orifice-forming member layer A and the ejection orifice-forming member layer B. The water-repellent projection portion is formed at least on a portion of the inner wall of the ejection orifice, the portion being the surface of the tip of the protrusion.

The liquid ejection head according to this embodiment includes, within the ejection orifice, a protrusion protruding into the ejection orifice, so that the protrusion holds liquid to thereby decrease the length of the tails of droplets at the time of ejection of droplets. This results in a reduction in the amount of satellite droplets and mist, to thereby improve printing quality. In addition, the liquid ejection head according to this embodiment includes, on the surface of the tip of the protrusion, a water-repellent projection portion, which is a portion of the intermediate water-repellent layer, the portion projecting into the ejection orifice, so that a liquid film formed on the protrusion is divided at an earlier timing and between the ejection orifice-forming member layer A and the ejection orifice-forming member layer B. As a result, even with an increase in the protrusion gap width for the purpose of decreasing the forward resistance, the amount of satellite droplets and mist can be sufficiently decreased. Thus, the amount of satellite droplets and mist can be decreased to improve printing quality, and ejection stability at the time of restarting of ejection of liquid can be improved.

Hereinafter, this embodiment according to the disclosure will be described with reference to drawings. An example to which the disclosure is applicable will be described with an inkjet recording head, which is one of liquid ejection heads. However, the scope to which a liquid ejection head according to the disclosure is applicable is not limited to the inkjet recording head. In the following description, features different from those of the first embodiment will be mainly described, and redundant descriptions of some features having been described in the first embodiment are omitted.

Figure 8A:
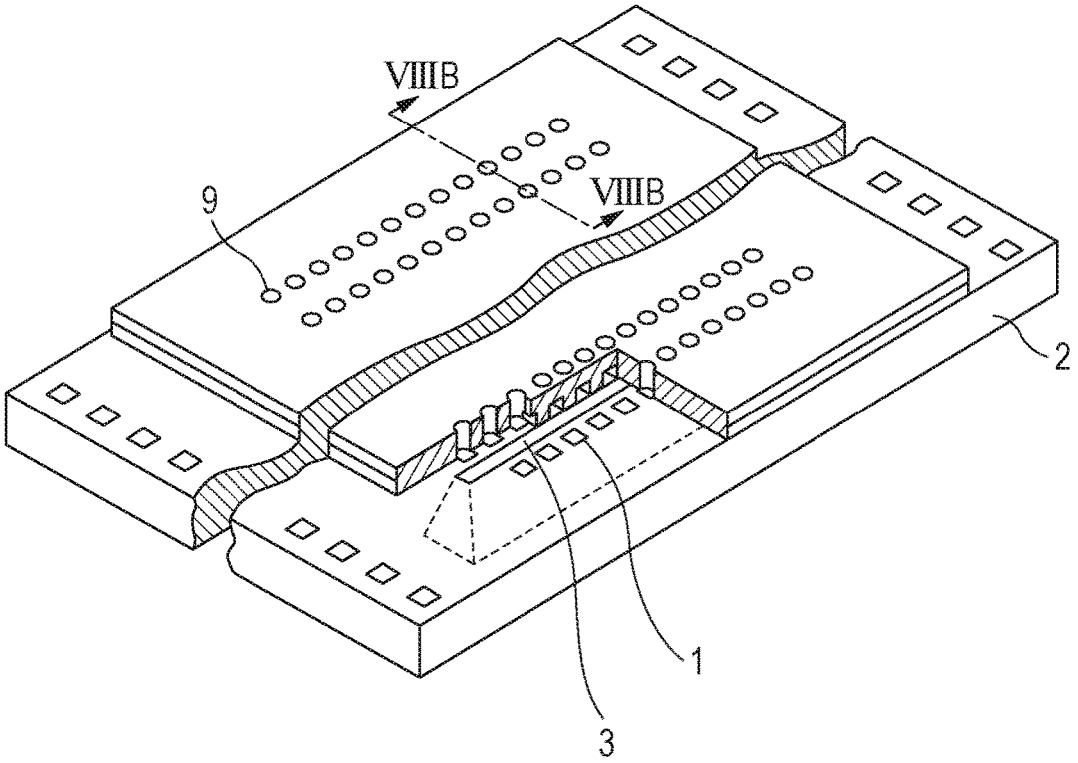
FIGS. 8A and 8B are a perspective view and a sectional view that illustrate an example of an inkjet recording head according to a second embodiment of the disclosure.
Figure 8B:
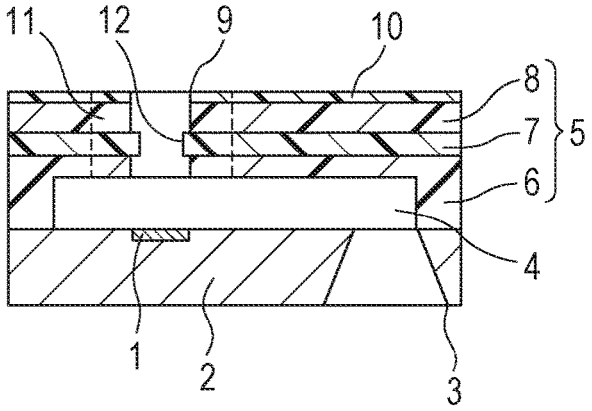

FIG. 8A is a schematic view that illustrates an example of the inkjet recording head according to this embodiment. FIG. 8B is a schematic sectional view of the inkjet recording head taken along line VIIIB-VIIIB in FIG. 8A. The inkjet recording head illustrated in FIGS. 8A and 8B includes a substrate 2 in which energy generating elements 1, which generate energy used for ejecting ink, are formed at a predetermined pitch. In the substrate 2, a supply passage 3, which supplies ink, is formed so as to extend through the substrate 2. On the substrate 2, an ejection orifice-forming member 5 is formed, which forms a channel 4 for ink and ejection orifices 9 for ink. The ejection orifice-forming member 5 includes an ejection orifice-forming member layer A 6, an intermediate water-repellent layer 7, and an ejection orifice-forming member layer B 8. Within each ejection orifice 9, protrusions 11 are formed so as to protrude into the ejection orifice 9. Incidentally, the phrase "protrude into the ejection orifice 9" means protrusion in a direction toward the center line extending in the ejection direction of ink (liquid) in the ejection orifice 9. In addition to the protrusions 11, a water-repellent projection portion 12 is formed, which is a portion of the intermediate water-repellent layer 7 on the tips of the protrusions 11 and projects farther into the ejection orifice 9 than the ejection orifice-forming member layer A 6 and the ejection orifice-forming member layer B 8. Incidentally, the phrase "project into the ejection orifice 9" means projection in a direction toward the center line extending in the ejection direction of ink (liquid) in the ejection orifice 9. On a first surface of the ejection orifice-forming member 5, the first surface having the ejection orifice 9 being exposed, a surface water-repellent layer 10 is formed. In the inkjet recording head illustrated in FIGS. 8A and 8B, to ink supplied from the supply passage 3 through the channel 4, energy generated by the energy generating elements 1 is applied, so that the ink is ejected as ink droplets through the ejection orifices 9.

Figure 9A:
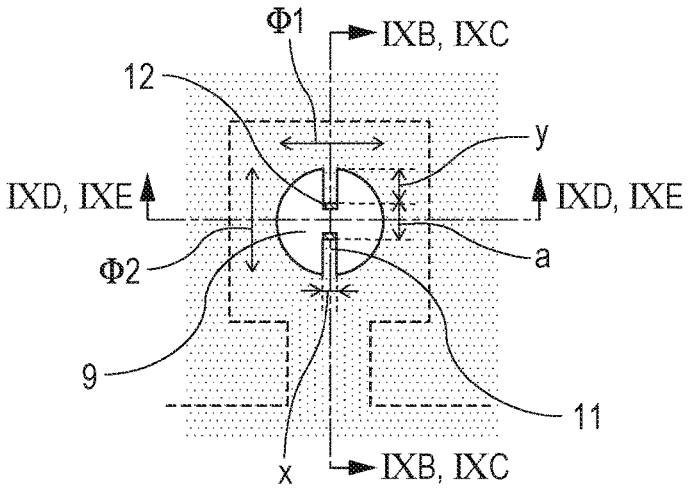
FIGS. 9A to 9E are a top view and sectional views that illustrate a region at and near an ejection orifice of an example of an inkjet recording head according to a second embodiment of the disclosure.
Figure 9B:
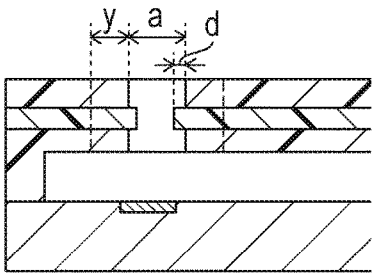
Figure 9C:
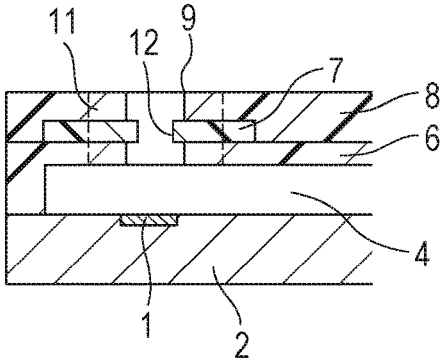
Figure 9D:
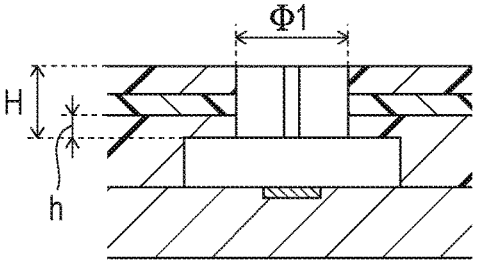
Figure 9E:
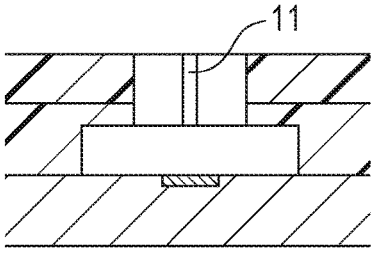

FIG. 9A is a top view that illustrates an example of a region at and near an ejection orifice 9 (viewed from the liquid ejection side) of the inkjet recording head according to this embodiment. FIGS. 9B and 9C are sectional views of the region taken along line IXB, IXC-IXB, IXC in FIG. 9A. FIGS. 9D and 9E are sectional views of the region taken along line IXD, IXE-IXD, IXE in FIG. 9A. As illustrated in FIGS. 9A to 9E, the inkjet recording head according to this embodiment includes a water-repellent projection portion 12, which is a portion of the intermediate water-repellent layer 7 on the surfaces of the tips of the protrusions 11 and which projects farther into the ejection orifice 9 by a length d than the ejection orifice-forming member layer A 6 and the ejection orifice-forming member layer B 8. The ejection orifice 9 has a larger diameter Φ1 and a shorter diameter Φ2. The protrusions 11 have a width x, a length y, and a gap width a.

Referring to FIGS. 3A to 3C, comparison with the conventional inkjet recording head will be performed. Ink to which energy for ejection is being applied forms a liquid column extending in the ejection direction; and the trailing end of the liquid column breaks and the liquid column is ejected as an ink droplet. The ink droplet immediately after ejection has an elongated shape referred to as a droplet tail. When this droplet tail is long, in addition to the main droplet, satellite droplets following the main droplet are generated, and mist that does not impact on the paper surface is generated. The conventional inkjet recording head illustrated in FIGS. 3A to 3C has protrusions 11 within an ejection orifice 9. The protrusions 11 turn the liquid column into a liquid film, which results in earlier breakage of the liquid column and hence a short droplet tail. In this structure, the smaller the gap width a between the protrusions 11, the smaller the amount of satellite droplets and mist, but the higher the forward resistance within the ejection orifice 9.

Figure 10A:
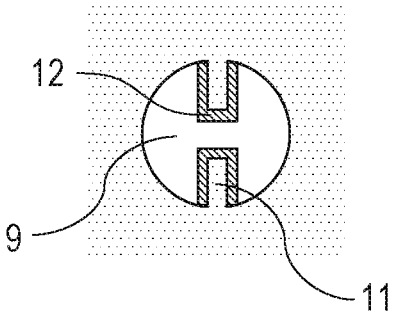
FIGS. 10A and 10B are top views that illustrate examples of the shape of an ejection orifice of an inkjet recording head according to a second embodiment of the disclosure.
Figure 10B:
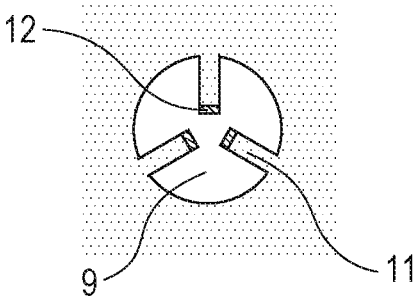

On the other hand, as illustrated in FIGS. 9A to 9E, the inkjet recording head according to this embodiment includes water-repellent projection portions 12 at the tips of the protrusions 11. The water-repellent projection portions 12 are portions of the intermediate water-repellent layer 7 that project into the ejection orifice 9. Since the water-repellent projection portions 12 have water repellency, a liquid film having been turned from a liquid column and at the protrusions (water-repellent projection portions) 12 is divided at an earlier timing and between the ejection orifice-forming member layer A 6 and the ejection orifice-forming member layer B 8, hence breakage of the liquid column occurs at an earlier timing. Thus, even with an increased gap width a between the protrusions 11 for the purpose of decreasing the forward resistance, the amount of satellite droplets and mist is sufficiently decreased. As illustrated in FIGS. 9B and 9D, the intermediate water-repellent layer 7 may be formed so as to cover the whole surface of the ejection orifice-forming member layer A 6; or, as illustrated in FIGS. 9C and 9E, the intermediate water-repellent layer 7 may be patterned so as to cover an area of the surface of the ejection orifice-forming member layer A 6. Incidentally, the shape of the ejection orifice 9 according to this embodiment is not limited to that is illustrated in FIG. 9A, and may be appropriately selected from, for example, the shapes illustrated in FIGS. 10A and 10B. The horizontal sectional shape of the ejection orifice 9 other than the protrusions 11 is not limited to circular arcs.

Each protrusion 11 may be constituted by the intermediate water-repellent layer 7 and the ejection orifice-forming member layer B 8. Alternatively, the protrusion 11 may be constituted by the ejection orifice-forming member layer A 6 and the intermediate water-repellent layer 7. Alternatively, the protrusion 11 may be constituted by the ejection orifice-forming member layer A 6, the intermediate water-repellent layer 7, and the ejection orifice-forming member layer B 8. The length (in the depth direction of the ejection orifice 9) of the protrusion 11 is not particularly limited, and may be 6 to 50 μm.

A static contact angle $\theta_s$ of the water-repellent projection portion 12 for pure water, a static contact angle $\theta_A$ of the ejection orifice-forming member layer A 6 for pure water, and a static contact angle $\theta_B$ of the ejection orifice-forming member layer B 8 for pure water preferably satisfy $\theta_s>\theta_A$ and $\theta_s>\theta_B$. When $\theta_s>\theta_A$ and $\theta_s>\theta_B$ are satisfied, the liquid film having been turned from a liquid column and at the water-repellent projection portion 12, is divided at an earlier timing and between the ejection orifice-forming member layer A 6 and the ejection orifice-forming member layer B 8, hence breakage of the liquid column occurs at an earlier timing. Thus, even with an increased gap width a between the protrusions 11 for the purpose of decreasing the forward resistance, the amount of satellite droplets and mist is sufficiently decreased. This is because the meniscus of the liquid is easily maintained at the position of the water-repellent projection portion 12. $\theta_s$ is preferably 10° or more larger than $\theta_A$ and $\theta_B$, more preferably, 20° or more larger than $\theta_A$ and $\theta_B$.

$\theta_s>70°$ is preferably satisfied from the viewpoint that the liquid film having been turned from a liquid column and at the water-repellent projection portion 12, is divided at an earlier timing and between the ejection orifice-forming member layer A 6 and the ejection orifice-forming member layer B 8, hence breakage of the liquid column occurs at an earlier timing. $\theta_s$ more preferably satisfies $\theta_s>80°$, still more preferably $\theta_s>90°$. The upper limit of $\theta_s$ is not particularly limited; however, for example, $\theta_s$ satisfies $\theta_s\leq120°$. The ranges of $\theta_A$ and $\theta_B$ are not particularly limited; for example, $\theta_A$ and $\theta_B$ can satisfy $50°\leq\theta_A\leq70°$ and $10°\leq\theta_B\leq70°$. Incidentally, $\theta_s$, $\theta_A$, and $\theta_B$ are measured with a contact angle meter CA-X150 (trade name, manufactured by Kyowa Interface Science Co., Ltd.) by measuring the contact angle of a 10 μl pure water droplet.

The channel 4 is not particularly limited in terms of height; however, the height can be 3 to 20 μm. The ejection orifice-forming member layer A 6 over the channel 4 may have a thickness h that is ⅙ or more of the thickness H of the ejection orifice-forming member 5 over the channel 4.

The intermediate water-repellent layer 7 preferably has a thickness of 0.3 μm or more, more preferably 1 to 3 μm. The ejection orifice-forming member layer B 8 on the intermediate water-repellent layer 7 is not particularly limited in terms of thickness; however, the thickness can be ⅙ or more of the thickness H of the ejection orifice-forming member 5 over the channel 4. The ejection orifice-forming member 5 over the channel 4 is not particularly limited in terms of thickness H; however, the thickness H can be 6 to 50 μm. When the ejection orifice 9 has a circular shape, the larger diameter Φ1 is not particularly limited and can be 10 to 30 μm. The shorter diameter Φ2 is not particularly limited and can be 10 to 30 μm. The width x of the protrusion 11 is not particularly limited, and can be 1.5 to 5 μm. The length y of the protrusion 11 is not particularly limited, and can be ⅙ or more of the shorter diameter Φ2. When plural protrusions 11 are formed, the gap width a of the protrusions 11 is not particularly limited, and can be 1 to 15 μm. The projection length d of the water-repellent projection portion 12 is preferably 0.1 to 3 μm, more preferably 0.5 to 1.5 μm.

Method for Producing Liquid Ejection Head

Some examples of a method for producing a liquid ejection head according to the second embodiment, the following fourth and fifth production methods, will be described. Incidentally, inkjet recording heads, which are examples of liquid ejection heads, will be described as examples to which the disclosure is applicable. However, the scope to which a method for producing a liquid ejection head according to the disclosure is applicable is not limited to inkjet recording heads.

(4) Fourth Production Method

A method for producing a liquid ejection head according to this embodiment includes a step of forming, on a substrate, a shape member used for forming a liquid channel and formed of a channel-forming resin composition; a step of forming, on the shape member and the substrate, a layer that is formed of a photosensitive resin composition A and that is curable into an ejection orifice-forming member layer A; a step of forming, on the layer formed of the photosensitive resin composition A, a layer that is formed of a photosensitive resin composition C and that is curable into an intermediate water-repellent layer; a step of forming, on the layer formed of the photosensitive resin composition C, a layer that is formed of a photosensitive resin composition B and that is curable into an ejection orifice-forming member layer B; a step of exposing the layer formed of the photosensitive resin composition A, the layer formed of the photosensitive resin composition C, and the layer formed of the photosensitive resin composition B, to form a pattern of an ejection orifice for ejecting liquid, a protrusion protruding into the ejection orifice, and a water-repellent projection portion; a step of removing unexposed regions from the layer formed of the photosensitive resin composition A, the layer formed of the photosensitive resin composition C, and the layer formed of the photosensitive resin composition B; and a step of removing the shape member. The water-repellent projection portion is a portion of the intermediate water-repellent layer on the tip of the protrusion, and projects farther into the ejection orifice than the ejection orifice-forming member layer A and the ejection orifice-forming member layer B. According to this method, the liquid ejection head according to this embodiment can be efficiently produced with high accuracy.

FIGS. 11A to 11G are schematic sectional views that illustrate steps in the method for producing an inkjet recording head that is an example of this embodiment. These schematic sectional views are sectional views taken along line IXB, IXC-IXB, IXC in FIG. 9A. The same applies to FIGS. 12A to 12G.

Figure 11A:
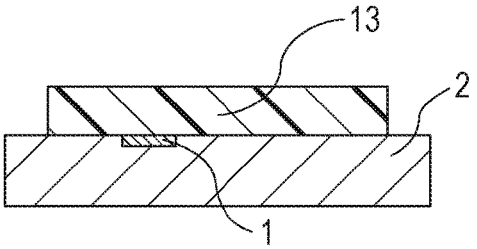
FIGS. 11A to 11G are sectional views that illustrate an example of a method for producing an inkjet recording head according to a second embodiment of the disclosure.

As illustrated in FIG. 11A, on a substrate 2 in which energy generating elements 1 are disposed, a shape member 13 used for forming a liquid channel and formed of a channel-forming resin composition is first formed. For example, on the substrate 2 in which the energy generating elements 1 are disposed, a layer formed of the channel-forming resin composition is formed and then exposed through a channel pattern mask, and the exposed regions are dissolved and removed to thereby form the shape member 13. The channel-forming resin composition is not particularly limited as long as it can be removed after formation of an ejection orifice-forming member 5. Examples of the composition include compositions that have positive photolithographic performance and are decomposed with Deep-UV to become soluble in organic solvents, such as polymethacrylate positive resists and polyacrylate positive resists. In particular, polymethyl isopropenyl ketone can be used. For polymethyl isopropenyl ketone, an example of a commercially available product is ODUR-1010 (trade name, manufactured by TOKYO OHKA KOGYO CO., LTD.).

Figure 11B:
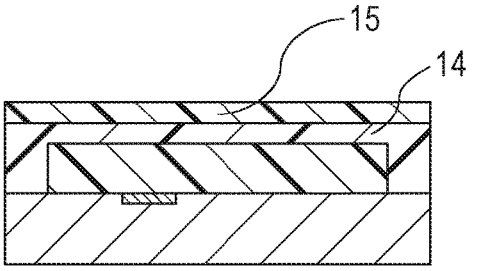

Subsequently, as illustrated in FIG. 11B, on the shape member 13 and the substrate 2, a layer 14 formed of the photosensitive resin composition A and a layer 15 formed of the photosensitive resin composition C are formed in this order. The layer 14 formed of the photosensitive resin composition A is a layer that is curable into an ejection orifice-forming member layer A 6. The layer 15 formed of the photosensitive resin composition C is a layer that is curable into an intermediate water-repellent layer 7. As described above, the photosensitive resin composition A can contain a cationically polymerizable resin having two or more epoxy groups, and a photoacid generating agent that generates acid upon absorption of light. As described above, the photosensitive resin composition C can contain a condensate of a hydrolyzable silane compound having an epoxy group and a hydrolyzable silane compound having a perfluoropolyether group or a perfluoroalkyl group, a cationically polymerizable resin having two or more epoxy groups, and a photoacid generating agent that generates acid upon absorption of light. The layer 14 formed of the photosensitive resin composition A and the layer 15 formed of the photosensitive resin composition C may be formed by the following method, for example: the photosensitive resin compositions containing solvents are applied by spin coating or slit coating, and the solvents are then evaporated by a baking step. Alternatively, a lamination method may be employed: the layers are temporarily formed on a film substrate formed of, for example, PET (polyethylene terephthalate) or polyimide, and the layers are subsequently transferred. Such formation methods can be appropriately selected in accordance with the type of resin material and the type of solvents.

Figure 11C:
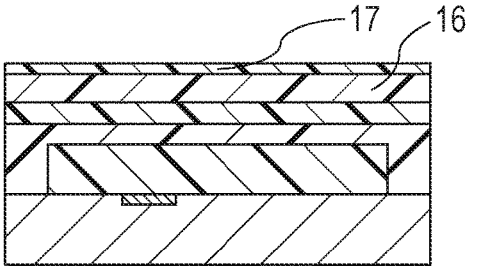

Subsequently, as illustrated in FIG. 11C, on the layer 15 formed of the photosensitive resin composition C, a layer 16 formed of the photosensitive resin composition B and a layer 17 formed of a photosensitive resin composition D are formed in this order. The layer 16 formed of the photosensitive resin composition B is a layer that is curable into an ejection orifice-forming member layer B 8. The layer 17 formed of the photosensitive resin composition D is a layer that is curable into a surface water-repellent layer 10. As described above, the photosensitive resin composition B can contain a cationically polymerizable resin having two or more epoxy groups, and a photoacid generating agent that generates acid upon absorption of light. The photosensitive resin composition D can contain the above-described material of the surface water-repellent layer 10. Incidentally, in the steps illustrated in FIGS. 11A to 11G, the surface water-repellent layer 10 is formed; however, the formation of the surface water-repellent layer 10 is optional.

Figure 11D:
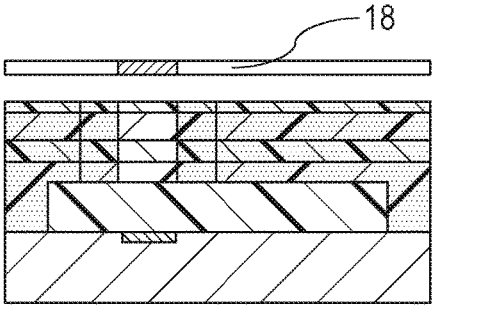

Subsequently, as illustrated in FIG. 11D, the layer 14 formed of the photosensitive resin composition A, the layer 15 formed of the photosensitive resin composition C, the layer 16 formed of the photosensitive resin composition B, and the layer 17 formed of the photosensitive resin composition D are exposed through an ejection orifice pattern mask 18. As a result, a pattern of ejection orifices 9 and protrusions 11, which protrude into the ejection orifices 9, is formed. The ejection orifice pattern mask 18 may be a mask including a substrate formed of a material that transmits light at the exposure wavelength, such as glass or quartz, and a light-shielding film (such as a chromium film) formed on the substrate so as to correspond to the pattern. The same applies to other masks described later. Examples of the exposure system include projection aligners that employ a single-wavelength light source such as i-line exposure steppers and KrF steppers, or that employ a mercury lamp as a light source such as a mask aligner MPA-600Super (trade name, manufactured by CANON KABUSHIKI KAISHA). A broad-wavelength exposure system may be used in combination with a filter that transmits light at a specific wavelength. The same applies to other exposure processes described later. In this step, the exposure dose, which may be determined in accordance with the materials of the photosensitive resin compositions, may be, for example, 500 to 20000 J/m$^2$.

Figure 11E:
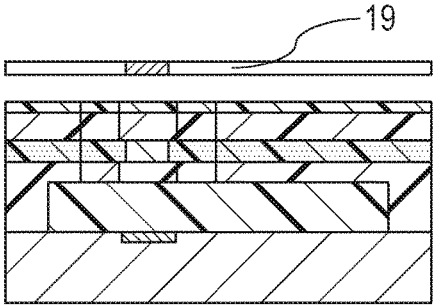

Subsequently, as illustrated in FIG. 11E, the layer 15 formed of the photosensitive resin composition C is exposed through a water-repellent projection portion pattern mask 19, to form a pattern of the water-repellent projection portions 12. The photosensitive resin composition A, the photosensitive resin composition B, and the photosensitive resin composition C are selected so as to have different sensitivities. In the exposure through the water-repellent projection portion pattern mask 19, an exposure dose that causes curing of only the photosensitive resin composition C is selected, to thereby form the water-repellent projection portions 12. Specifically, the curing exposure doses for the photosensitive resin composition A, the photosensitive resin composition B, and the photosensitive resin composition C are respectively represented by Eth1, Eth2, and Eth3. When an exposure dose E satisfies Eth1>E>Eth3 and Eth2>E>Eth3, the photosensitive resin composition C alone can be cured. Thus, Eth1>Eth3 and Eth2>Eth3 can be satisfied. Incidentally, such a curing exposure dose denotes a minimum exposure dose E=Eth at which a negative photosensitive resin composition becomes insoluble in the solvent used for dissolving and removing the composition, in other words, the photosensitive resin composition remains as residue during development and cannot be removed. The curing exposure doses for the photosensitive resin compositions can be adjusted by, for example, changing the type or addition amount of the above-described photoacid generating agent, basic substance, acid generating agent, or photosensitizer. The same effect as in providing different sensitivities among photosensitive resin compositions can be expected by preparing photosensitive resin compositions having different sensitive wavelengths through selection of different photoacid generating agents and different photosensitizers, and by using different exposure wavelengths for the photosensitive resin compositions. In this step, the exposure dose, which may be selected in accordance with the materials of the photosensitive resin compositions, may be, for example, 500 to 20000 J/m$^2$.

Figure 11F:
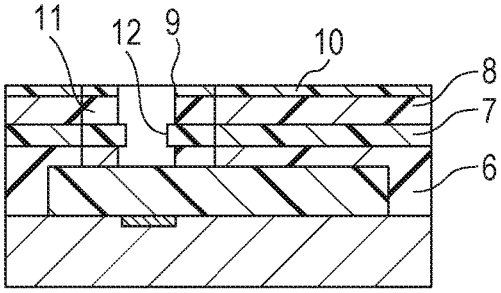

Subsequently, as illustrated in FIG. 11F, the unexposed regions are removed from the layer 14 formed of the photosensitive resin composition A, the layer 15 formed of the photosensitive resin composition C, the layer 16 formed of the photosensitive resin composition B, and the layer 17 formed of the photosensitive resin composition D. For example, the exposed regions are first cured by heat treatment (Post Exposure Bake). After that, the uncured regions can be removed with a solvent from the layer 14 formed of the photosensitive resin composition A, the layer 15 formed of the photosensitive resin composition C, the layer 16 formed of the photosensitive resin composition B, and the layer 17 formed of the photosensitive resin composition D. The solvent, which may be selected in accordance with the materials of the photosensitive resin compositions, may be, for example, propylene glycol monomethyl ether acetate (PGMEA), or methyl isobutyl ketone (MIBK). As a result, the following are formed: the ejection orifice-forming member layer A 6, the intermediate water-repellent layer 7, the ejection orifice-forming member layer B 8, the ejection orifices 9, the surface water-repellent layer 10, the protrusions 11, and the water-repellent projection portions 12.

Figure 11G:
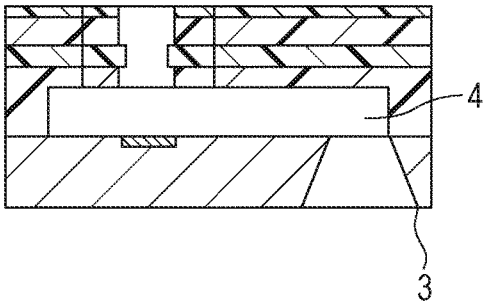

Subsequently, as illustrated in FIG. 11G, a liquid supply passage 3 is formed in the substrate 2, and the shape member 13 is removed. For example, after the ejection orifice-forming member on the substrate 2 is protected with a rubber film, an alkaline etchant may be used to form the supply passage 3 in the substrate 2. In addition, after the removal of the rubber film, the shape member 13 is dissolved and removed with a solvent to thereby form the channel 4. The solvent, which may be selected in accordance with the material of the shape member 13, may be, for example, methyl lactate. Incidentally, when the shape member 13 is formed of a positive resist, it may be irradiated with ultraviolet rays to enhance the solubility. In the step illustrated in FIG. 11A, when a lamination process is employed to form the shape member 13, at the time of the step illustrated in FIG. 11A, a substrate 2 in which a supply passage 3 has been formed can be used.

The method according to this embodiment can further include a step of performing heating at 90° C. or more and 250° C. or less after the step of removing the unexposed regions from the layer 14 formed of the photosensitive resin composition A, the layer 15 formed of the photosensitive resin composition C, the layer 16 formed of the photosensitive resin composition B, and optionally the layer 17 formed of the photosensitive resin composition D. The heating temperature is more preferably 120° C. or more and 240° C. or less, still more preferably 150° C. or more and 220° C. or less. When the heating temperature is 90° C. or more, the fluorine-containing groups of the water-repellent projection portion 12 can be made to sufficiently segregate at the interface between the water-repellent projection portion 12 and the air, to thereby sufficiently decrease the surface energy, compared with the ejection orifice-forming member layer A 6 and the ejection orifice-forming member layer B 8. As a result, the liquid film having been turned from a liquid column and at the water-repellent projection portions 12, is divided at an earlier timing and between the ejection orifice-forming member layer A 6 and the ejection orifice-forming member layer B 8, hence breakage of the liquid column occurs at an earlier timing. In addition, when the heating temperature is 250° C. or less, degradation of the durability of the ejection orifice-forming member due to decomposition of the resin can be sufficiently prevented. Incidentally, the heating step may be performed after the step of removing the shape member 13.

After that, electrical connections are established, and an ink supply unit is appropriately disposed to thereby provide an inkjet recording head.

(5) Fifth Production Method

A method for producing a liquid ejection head according to this embodiment includes a step of forming, on a substrate, a shape member used for forming a liquid channel and formed of a channel-forming resin composition; a step of forming, on the shape member and the substrate, a layer that is formed of a photosensitive resin composition A and that is curable into an ejection orifice-forming member layer A; a step of exposing the layer formed of the photosensitive resin composition A, to form a pattern of an ejection orifice for ejecting liquid and a protrusion protruding into the ejection orifice; a step of forming, on the layer formed of the photosensitive resin composition A, a layer that is formed of a photosensitive resin composition C and that is curable into an intermediate water-repellent layer; a step of exposing the layer formed of the photosensitive resin composition C, to form a pattern of the ejection orifice, the protrusion, and a water-repellent projection portion; a step of removing unexposed regions from the layer formed of the photosensitive resin composition A and the layer formed of the photosensitive resin composition C; a step of forming, on the intermediate water-repellent layer, a layer that is formed of a photosensitive resin composition B and that is curable into an ejection orifice-forming member layer B; a step of exposing the layer formed of the photosensitive resin composition B, to form a pattern of the ejection orifice and the protrusion; a step of removing unexposed regions from the layer formed of the photosensitive resin composition B; and a step of removing the shape member. The water-repellent projection portion is a portion of the intermediate water-repellent layer on the tip of the protrusion, and projects farther into the ejection orifice than the ejection orifice-forming member layer A and the ejection orifice-forming member layer B. According to this method, the liquid ejection head according to this embodiment can be efficiently produced with high accuracy.

FIGS. 12A to 12G are schematic sectional views that illustrate steps in the method for producing an inkjet recording head that is an example of this embodiment. Incidentally, in the steps illustrated in FIGS. 12A to 12G, formation of the surface water-repellent layer 10 is omitted. However, as in the above-described production method illustrated in FIGS. 11A to 11G, the surface water-repellent layer 10 may be formed.

Figure 12A:
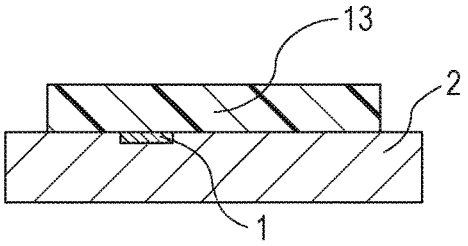
FIGS. 12A to 12G are sectional views that illustrate an example of a method for producing an inkjet recording head according to a second embodiment of the disclosure.

As illustrated in FIG. 12A, on a substrate 2 in which energy generating elements 1 are disposed, a shape member 13 used for forming a liquid channel and formed of a channel-forming resin composition is first formed. The shape member 13 can be formed in the same manner as in the first embodiment.

Figure 12B:
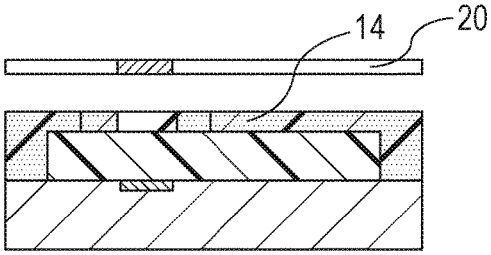

Subsequently, as illustrated in FIG. 12B, on the shape member 13 and the substrate 2, a layer 14 formed of the photosensitive resin composition A is formed, and exposed through an ejection orifice pattern mask 20, to form a pattern of ejection orifices 9 and protrusions 11, which protrude into the ejection orifices 9. The formation of the layer 14 formed of the photosensitive resin composition A and the exposure through the ejection orifice pattern mask 20 can be performed in the same manner as in the first embodiment. After the exposure, heat treatment may be performed to cure the exposed regions.

Figure 12C:
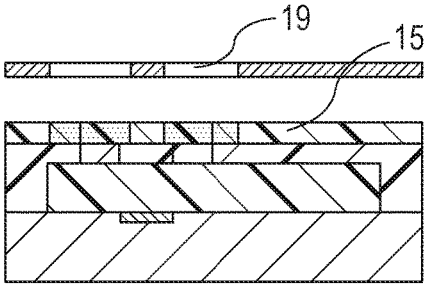

Subsequently, as illustrated in FIG. 12C, on the layer 14 formed of the photosensitive resin composition A, a layer 15 formed of the photosensitive resin composition C is formed, and exposed through a water-repellent projection portion pattern mask 19. As a result, in the layer 15 formed of the photosensitive resin composition C, a pattern of the ejection orifices 9, the protrusions 11, and water-repellent projection portions 12 is formed. The photosensitive resin composition A and the photosensitive resin composition C are selected so as to have different sensitivities. In the exposure through the water-repellent projection portion pattern mask 19, an exposure dose that causes curing of only the photosensitive resin composition C is selected, to thereby form the water-repellent projection portions 12. Specifically, the curing exposure doses of the photosensitive resin composition A and the photosensitive resin composition C are respectively represented by Eth1 and Eth3. When an exposure dose E satisfies Eth1>E>Eth3, the photosensitive resin composition C alone can be cured. Thus, Eth1>Eth3 can be satisfied. The formation of the layer 15 formed of the photosensitive resin composition C and the exposure through the water-repellent projection portion pattern mask 19 can be performed in the same manner as in the first embodiment. After the exposure, heat treatment may be performed to cure the exposed regions.

Figure 12D:
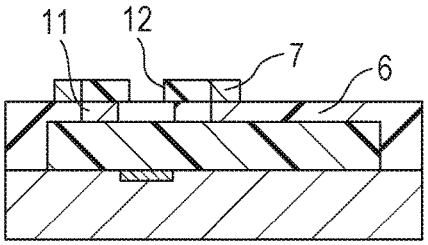

Subsequently, as illustrated in FIG. 12D, the unexposed regions are removed from the layer 14 formed of the photosensitive resin composition A and the layer 15 formed of the photosensitive resin composition C. The unexposed regions can be removed with a solvent. The solvent, which may be selected in accordance with the materials of the photosensitive resin compositions, may be, for example, PGMEA or MIBK. As a result, the following are formed: the ejection orifice-forming member layer A 6, the intermediate water-repellent layer 7, portions of the protrusions 11, and the water-repellent projection portions 12.

Figure 12E:
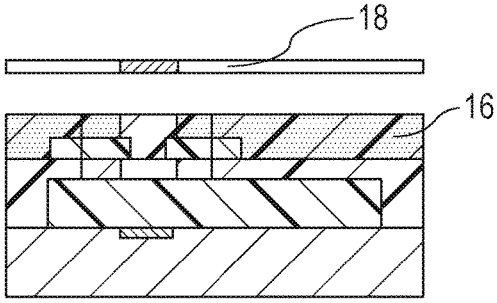

Subsequently, as illustrated in FIG. 12E, on the intermediate water-repellent layer 7 and the ejection orifice-forming member layer A 6, a layer 16 formed of the photosensitive resin composition B is formed and exposed through an ejection orifice pattern mask 18, to form a pattern of the ejection orifices 9 and the protrusions 11. The layer 16 formed of the photosensitive resin composition B can be formed by a lamination process. The exposure through the ejection orifice pattern mask 18 can be performed in the same manner as in the first embodiment. After the exposure, heat treatment may be performed to cure the exposed regions.

Figure 12F:
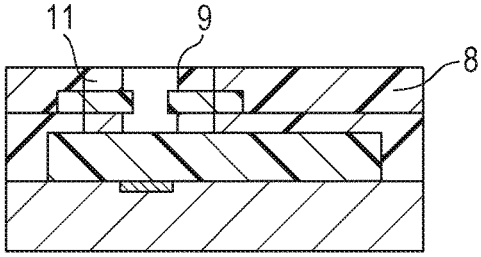

Subsequently, as illustrated in FIG. 12F, the unexposed regions are removed from the layer 16 formed of the photosensitive resin composition B. The removal of the unexposed regions can be performed with a solvent. The solvent, which may be selected in accordance with the material of the photosensitive resin composition B, may be, for example, PGMEA or MIBK. As a result, the following are formed: the ejection orifice-forming member layer B 8, the ejection orifices 9, and the protrusions 11.

Figure 12G:
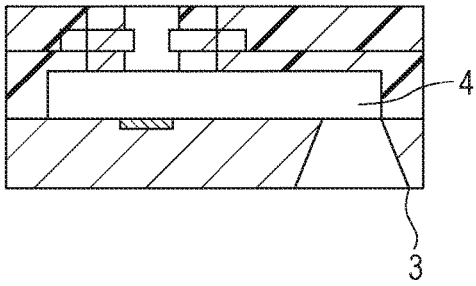

Subsequently, as illustrated in FIG. 12G, a liquid supply passage 3 is formed in the substrate 2. The shape member 13 is removed to form a liquid channel 4. The formation of the supply passage 3 and the removal of the shape member 13 can be performed in the same manner as in the first embodiment. Incidentally, in the step illustrated in FIG. 12A, when a lamination process is employed for forming the shape member 13, at the time of the step illustrated in FIG. 12A, a substrate 2 in which a supply passage 3 has been formed can be used.

As in the first embodiment, the method according to this embodiment can further include a step of performing heating at 90° C. or more and 250° C. or less after the step of removing the unexposed regions from the layer 16 formed of the photosensitive resin composition B. Incidentally, the heating step may be performed after the step of removing the shape member 13.

After that, electrical connections are established, and an ink supply unit is appropriately disposed to thereby provide an inkjet recording head.

EXAMPLES

Example 1

In this Example, the steps illustrated in FIGS. 5A to 5G were performed to produce an inkjet recording head. Incidentally, in the steps illustrated in FIGS. 5A to 5G, on the layer 16 formed of the photosensitive resin composition B, the layer 17 formed of the photosensitive resin composition D and being curable into the surface water-repellent layer 10, is formed. However, in this Example, the layer 17 formed of the photosensitive resin composition D was not formed.

As illustrated in FIG. 5A, on a substrate 2, a shape member 13 used for forming a liquid channel and formed of a channel-forming resin composition was formed. Specifically, onto the substrate 2 formed of silicon in which energy generating elements 1 for generating energy for ejecting liquid were disposed, polymethyl isopropenyl ketone (manufactured by TOKYO OHKA KOGYO CO., LTD., trade name: ODUR-1010) was applied. After that, heat treatment was performed at 120° C. for 5 minutes, to form a layer having a thickness of 15 μm and formed of the channel-forming resin composition. The layer formed of the channel-forming resin composition was exposed through a channel pattern mask with an exposure system UX3000 (trade name, manufactured by USHIO INC.). The exposed regions were dissolved and removed with MIBK. Thus, the shape member 13 was formed.

Subsequently, as illustrated in FIG. 5B, on the shape member 13 and the substrate 2, a layer 14 formed of a photosensitive resin composition A and a layer 15 formed of a photosensitive resin composition C were formed in this order. Specifically, onto the shape member 13 and the substrate 2, a photosensitive resin composition was applied by spin coating, the photosensitive resin composition being curable into an ejection orifice-forming member layer A 6 and composed of the components described in Table 1. After that, heat treatment was performed at 90° C. for 5 minutes, to form the layer 14 formed of the photosensitive resin composition A and having a thickness of 18 μm. Furthermore, onto the layer 14 formed of the photosensitive resin composition A, a photosensitive resin composition was applied by slit coating, the photosensitive resin composition being curable into an intermediate water-repellent layer 7 and composed of the components described in Table 2. After that, heat treatment was performed at 50° C. for 3 minutes, to form the layer 15 formed of the photosensitive resin composition C and having a thickness of 2 μm.

TABLE 1

| | Trade names and manufacturers | Content (Parts by mass) |
|---|---|---|
| Epoxy resin | 157S70, manufactured by Mitsubishi Chemical Corporation | 100.0 |

TABLE 1-continued

| | Trade names and manufacturers | Content (Parts by mass) |
|---|---|---|
| Photoacid generating agent | ADEKA OPTOMER SP-172, manufactured by ADEKA CORPORATION | 5.0 |
| Acid generating agent | TPS-1000, manufactured by Midori Kagaku Co., Ltd. | 0.2 |
| Silane coupling agent | A-187, manufactured by Momentive Performance Materials Inc. | 5.0 |
| Solvent (PGMEA) | — | 120.0 |

TABLE 2

| | Trade names and manufacturers | Content (Parts by mass) |
|---|---|---|
| Silane condensate | — | 1.0 |
| Epoxy resin | EHPE3150, manufactured by Daicel Corporation | 5.9 |
| Photoacid generating agent | CPI-410S, manufactured by San-Apro Ltd. | 0.1 |
| Solvent (ethanol) | — | 80.0 |

Incidentally, in Table 2, the silane condensate was prepared in the following manner. To a flask equipped with a condenser, the following compounds were added: 12.53 g (0.045 mol) of γ-glycidoxypropyltriethoxysilane, 8.02 g (0.0225 mol) of methyltriethoxysilane, 4.46 g (0.0225 mol) of phenyltrimethoxysilane, 0.96 g (0.726 mmol) of a compound represented by Formula (1) above, 5.93 g of water, 15.15 g of ethanol, and 3.83 g of hydrofluoroether (trade name: HFE7200, manufactured by Sumitomo 3M Limited). These compounds were stirred at room temperature for 5 minutes, and then heated to reflux for 24 hours. Thus, the silane condensate was prepared.

The photosensitive resin composition described in Table 1 was used to form a film on a silicon substrate. The film was exposed at 10000 J/m$^2$, and heat treatment was performed at 90° C. for 5 minutes. The resultant cured product was found to have a static contact angle for pure water ($\theta_A$, $\theta_B$) of 59°. The photosensitive resin composition described in Table 2 was used to form a film on a silicon substrate. The film was exposed at 1000 J/m$^2$, and heat treatment was performed at 90° C. for 5 minutes. The resultant cured product was found to have a static contact angle for pure water ($\theta_s$) of 98°. Incidentally, the static contact angles were measured with a contact angle meter CA-X150 (trade name, manufactured by Kyowa Interface Science Co., Ltd.) and as contact angles for a 10 μl pure water droplet.

Subsequently, as illustrated in FIG. 5C, on the layer 15 formed of the photosensitive resin composition C, a layer 16 formed of a photosensitive resin composition B was formed. Specifically, the photosensitive resin composition described in Table 1 and being curable into an ejection orifice-forming member layer B 8 was used to form a dry film. This dry film was disposed, by a lamination process, on the layer 15 formed of the photosensitive resin composition C. As a result, the layer 16 formed of the photosensitive resin composition B and having a thickness of 6 μm was formed. The dry film was prepared by applying, by spin coating, the photosensitive resin composition described in Table 1 onto a PET film having a thickness of 100 μm, and by heating the applied composition at 90° C. for 5 minutes to evaporate the solvent.

Subsequently, as illustrated in FIG. 5D, the layer 14 formed of the photosensitive resin composition A, the layer 15 formed of the photosensitive resin composition C, and the layer 16 formed of the photosensitive resin composition B were exposed, to thereby form a pattern of ejection orifices 9 and protrusions 11, which protruded into the ejection orifices 9. Specifically, the layer 14 formed of the photosensitive resin composition A, the layer 15 formed of the photosensitive resin composition C, and the layer 16 formed of the photosensitive resin composition B were patterned by exposure through an ejection orifice pattern mask 18 having a pattern for the ejection orifices 9 and the protrusions 11. The exposure was performed with an i-line exposure stepper at an exposure dose of 10000 J/m$^2$.

Subsequently, as illustrated in FIG. 5E, the layer 15 formed of the photosensitive resin composition C was exposed, to thereby form a pattern of water-repellent projection portions 12. Specifically, the layer 15 formed of the photosensitive resin composition C was patterned by exposure at an exposure dose of 1000 J/m$^2$, with an i-line exposure stepper, and through a water-repellent projection portion pattern mask 19 having a pattern for the water-repellent projection portions 12. Incidentally, the curing exposure dose Eth1 for the photosensitive resin composition A, the curing exposure dose Eth2 for the photosensitive resin composition B, and the curing exposure dose Eth3 for the photosensitive resin composition C satisfied Eth1>Eth3 and Eth2>Eth3. As a result, in this exposure, only the layer 15 formed of the photosensitive resin composition C was partially cured by the patterning exposure.

Subsequently, as illustrated in FIG. 5F, the unexposed regions were removed from the layer 14 formed of the photosensitive resin composition A, the layer 15 formed of the photosensitive resin composition C, and the layer 16 formed of the photosensitive resin composition B. Specifically, heating was performed at 90° C. for 4 minutes to cure the exposed regions, and then the unexposed regions were dissolved and removed with PGMEA from the layer 14 formed of the photosensitive resin composition A, the layer 15 formed of the photosensitive resin composition C, and the layer 16 formed of the photosensitive resin composition B. As a result, the following were formed: the ejection orifice-forming member layer A 6, the intermediate water-repellent layer 7, the ejection orifice-forming member layer B 8, the ejection orifices 9, the protrusions 11, and the water-repellent projection portions 12.

Subsequently, as illustrated in FIG. 5G, a liquid supply passage 3 was formed in the substrate 2, and the shape member 13 was removed. Specifically, the ejection orifice-forming member on the substrate 2 was protected with a rubber film, and then an alkaline etchant was used to form the supply passage 3 in the substrate 2. After that, the rubber film was removed, and the shape member 13 was dissolved and removed with methyl lactate to thereby form a liquid channel 4. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 5. Incidentally, the symbols in Table 5 correspond to those in FIGS. 2A, 2B, and 2D.

Example 2

In this Example, the steps illustrated in FIGS. 6A to 6G were performed to produce an inkjet recording head.

As illustrated in FIG. 6A, in the same manner as in Example 1, on a substrate 2, a shape member 13 used for forming a liquid channel was first formed from a channel-forming resin composition.

Subsequently, as illustrated in FIG. 6B, on the shape member 13 and the substrate 2, a layer 14 formed of a photosensitive resin composition A was formed and exposed, to thereby form a pattern of ejection orifices 9. Specifically, in the same manner as in Example 1, the layer 14 formed of the photosensitive resin composition A was formed. After that, the layer 14 formed of the photosensitive resin composition A was patterned by exposure at an exposure dose of 10000 J/m$^2$, with an i-line exposure stepper, and through an ejection orifice pattern mask 20 having a pattern for the ejection orifices 9.

Subsequently, as illustrated in FIG. 6C, on the layer 14 formed of the photosensitive resin composition A, a layer 15 formed of a photosensitive resin composition C was formed and exposed, to thereby form a pattern of the ejection orifices 9, protrusions 11, which protruded into the ejection orifices 9, and water-repellent projection portions 12. Specifically, in the same manner as in Example 1, the layer 15 formed of the photosensitive resin composition C was formed. After that, the layer 15 formed of the photosensitive resin composition C was patterned by exposure with an i-line exposure stepper, at an exposure dose of 1000 J/m$^2$, and through a water-repellent projection portion pattern mask 19 having a pattern for the ejection orifices 9, the protrusions 11, and the water-repellent projection portions 12. Incidentally, the curing exposure dose Eth1 for the photosensitive resin composition A and the curing exposure dose Eth3 for the photosensitive resin composition C satisfied Eth1>Eth3. As a result, in this exposure, only the layer 15 formed of the photosensitive resin composition C was partially cured by the patterning exposure.

Subsequently, as illustrated in FIG. 6D, the unexposed regions were removed from the layer 14 formed of the photosensitive resin composition A and the layer 15 formed of the photosensitive resin composition C. Specifically, heating was performed at 90° C. for 4 minutes to cure the exposed regions, and the unexposed regions were then dissolved and removed with PGMEA from the layer 14 formed of the photosensitive resin composition A and the layer 15 formed of the photosensitive resin composition C. As a result, the following were formed: the ejection orifice-forming member layer A 6, the intermediate water-repellent layer 7, portions of the protrusions 11, and the water-repellent projection portions 12.

Subsequently, as illustrated in FIG. 6E, on the intermediate water-repellent layer 7 and the ejection orifice-forming member layer A 6, a layer 16 formed of a photosensitive resin composition B was formed, and exposed, to thereby form a pattern of ejection orifices 9 and protrusions 11. Specifically, a dry film was prepared from a photosensitive resin composition described in Table 3, and was disposed by a lamination process on the intermediate water-repellent layer 7 and the ejection orifice-forming member layer A 6. Thus, the layer 16 formed of the photosensitive resin composition B and having a thickness of 6 μm was formed. The dry film was prepared by applying the photosensitive resin composition described in Table 3 by spin coating to a PET film having a thickness of 100 μm, and by heating the applied composition at 90° C. for 5 minutes to evaporate the solvent. After that, the layer 16 formed of the photosensitive resin composition B was patterned by exposure with an i-line exposure stepper, at an exposure dose of 4000 J/m$^2$, and through an ejection orifice pattern mask 18 having a pattern for the ejection orifices 9 and the protrusions 11.

TABLE 3

| | Trade names and manufacturers | Content (Parts by mass) |
|---|---|---|
| Epoxy resin | EHPE3150, manufactured by Daicel Corporation | 100.0 |
| Additive | 1,4-HFAB, manufactured by Central Glass Co., Ltd. | 20.0 |
| Photoacid generating agent | ADEKA OPTOMER SP-172, manufactured by ADEKA CORPORATION | 8.0 |
| Silane coupling agent | A-187, manufactured by Momentive Performance Materials Inc. | 5.0 |
| Solvent (xylene) | — | 140.0 |

Incidentally, the photosensitive resin composition described in Table 3 was used to form a film on a silicon substrate, and the film was exposed at 4000 J/m$^2$ and subjected to heat treatment at 90° C. for 5 minutes. The resultant cured product was found to have a static contact angle for pure water ($\theta_B$) of 60°.

Subsequently, as illustrated in FIG. 6F, the unexposed regions were removed from the layer 16 formed of the photosensitive resin composition B. Specifically, heating was performed at 90° C. for 4 minutes to cure the exposed regions, and then the unexposed regions were dissolved and removed with MIBK from the layer 16 formed of the photosensitive resin composition B. As a result, the following were formed: the ejection orifice-forming member layer B 8, the ejection orifices 9, and the protrusions 11.

Subsequently, as illustrated in FIG. 6G, as in Example 1, a liquid supply passage 3 was formed in the substrate 2, and the shape member 13 was removed to form a liquid channel 4. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 5.

Example 3

In this Example, the steps illustrated in FIGS. 7A to 7J were performed to produce an inkjet recording head.

As illustrated in FIG. 7A, on a substrate 2, a layer 22 formed of a photosensitive resin composition E and a layer 14 formed of a photosensitive resin composition A were formed in this order. Specifically, onto the substrate 2 formed of silicon in which energy generating elements 1 were disposed, a photosensitive resin composition composed of the components described in Table 1 was applied by spin coating, and heat treatment was performed at 90° C. for 5 minutes to form the layer 22 formed of the photosensitive resin composition E and having a thickness of 15 μm. Furthermore, a dry film was prepared from the photosensitive resin composition composed of the components described in Table 4. The dry film was disposed by a lamination process on the layer 22 formed of the photosensitive resin composition E, to form the layer 14 formed of the photosensitive resin composition A and having a thickness of 3 μm.

TABLE 4

| | Trade names and manufacturers | Content (Parts by mass) |
|---|---|---|
| Epoxy resin | EHPE3150, manufactured by Daicel Corporation | 100.0 |
| Additive | 1,4-HFAB, manufactured by Central Glass Co., Ltd. | 10.0 |
| Photoacid generating agent | CPI-410S, manufactured by San-Apro Ltd. | 1.2 |
| Silane coupling agent | A-187, manufactured by Momentive Performance Materials Inc. | 5.0 |
| Solvent (xylene) | — | 170.0 |

Subsequently, as illustrated in FIG. 7B, the layer 22 formed of the photosensitive resin composition E was exposed, to thereby form a pattern of a channel 4. Specifically, the layer 22 formed of the photosensitive resin composition E and the layer 14 formed of the photosensitive resin composition A were exposed with an i-line exposure stepper, at an exposure dose of 10000 J/m$^2$, and through a channel pattern mask 23 having a pattern for the channel 4.

Subsequently, as illustrated in FIG. 7C, the layer 14 formed of the photosensitive resin composition A was exposed, to thereby form the pattern of the ejection orifices 9. Specifically, the layer 14 formed of the photosensitive resin composition A was patterned by exposure with an i-line exposure stepper, at an exposure dose of 1000 J/m$^2$, and through an ejection orifice pattern mask 20 having a pattern for the ejection orifices 9. Incidentally, the curing exposure dose Eth1 for the photosensitive resin composition A and the curing exposure dose Eth4 for the photosensitive resin composition E satisfied Eth1<Eth4. As a result, in this exposure, only the layer 14 formed of the photosensitive resin composition A was partially cured by the patterning exposure.

Subsequently, as illustrated in FIG. 7D, the unexposed regions were removed from the layer 22 formed of the photosensitive resin composition E and the layer 14 formed of the photosensitive resin composition A. Specifically, heating was performed at 90° C. for 4 minutes to cure the exposed regions, and the unexposed regions were then dissolved and removed with PGMEA from the layer 22 formed of the photosensitive resin composition E and the layer 14 formed of the photosensitive resin composition A. As a result, the following were formed: the channel-forming member 21, the ejection orifice-forming member layer A 6, the channel 4, and portions of the ejection orifices 9.

Subsequently, as illustrated in FIG. 7E, on a film substrate 24, a layer 16 formed of a photosensitive resin composition B, and a layer 15 formed of a photosensitive resin composition C were formed in this order. Specifically, onto the film substrate 24 having a thickness of 100 μm and formed of PET, the photosensitive resin composition composed of the components described in Table 1 was applied by spin coating, and heat treatment was performed at 90° C. for 5 minutes to form the layer 16 formed of the photosensitive resin composition B and having a thickness of 6 μm. Furthermore, on the layer 16 formed of the photosensitive resin composition B, the photosensitive resin composition composed of the components described in Table 2 was applied by slit coating, and heat treatment was performed at 50° C. for 3 minutes, to form the layer 15 formed of the photosensitive resin composition C.

Subsequently, as illustrated in FIG. 7F, a lamination process was performed such that the layer 15 formed of the photosensitive resin composition C and the layer 16 formed of the photosensitive resin composition B on the film substrate 24 were transferred onto the ejection orifice-forming member layer A 6. As a result, on the ejection orifice-forming member layer A 6, the layer 15 formed of the photosensitive resin composition C and the layer 16 formed of the photosensitive resin composition B were formed in this order.

Subsequently, as illustrated in FIG. 7G, the layer 15 formed of the photosensitive resin composition C and the layer 16 formed of the photosensitive resin composition B were exposed, to thereby form a pattern of ejection orifices 9 and protrusions 11, which protrude into the ejection orifices. Specifically, the layer 15 formed of the photosensitive resin composition C and the layer 16 formed of the photosensitive resin composition B were patterned by exposure with an i-line exposure stepper, at an exposure dose of 10000 J/m$^2$, and through an ejection orifice pattern mask 18 having a pattern for the ejection orifices 9 and the protrusions 11.

Subsequently, as illustrated in FIG. 7H, the layer 15 formed of the photosensitive resin composition C was exposed, to thereby form a pattern of water-repellent projection portions 12. Specifically, the layer 15 formed of the photosensitive resin composition C was exposed with an i-line exposure stepper, at an exposure dose of 1000 J/m$^2$, and through a water-repellent projection portion pattern mask 19 having a pattern for the water-repellent projection portions 12. Incidentally, the curing exposure dose Eth2 for the photosensitive resin composition B and the curing exposure dose Eth3 for the photosensitive resin composition C satisfied Eth2>Eth3. As a result, in this exposure, only the layer 15 formed of the photosensitive resin composition C was partially cured by the patterning exposure.

Subsequently, as illustrated in FIG. 7I, the unexposed regions were removed from the layer 15 formed of the photosensitive resin composition C and the layer 16 formed of the photosensitive resin composition B. Specifically, heating was performed at 90° C. for 4 minutes to cure the exposed regions, and the unexposed regions were then dissolved and removed with PGMEA from the layer 15 formed of the photosensitive resin composition C and the layer 16 formed of the photosensitive resin composition B. As a result, the following were formed: the intermediate water-repellent layer 7, the ejection orifice-forming member layer B 8, the ejection orifices 9, the protrusions 11, and the water-repellent projection portions 12.

Subsequently, as illustrated in FIG. 7J, as in Example 1, a liquid supply passage 3 was formed in the substrate 2. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 5.

Example 4

An inkjet recording head was produced as in Example 1 except that the pattern of the water-repellent projection portion pattern mask 19 was changed such that the water-repellent projection portions 12 had a projection length d of 0.5 μm. The dimensions of components of the obtained inkjet recording head are described in Table 5.

Example 5

An inkjet recording head was produced as in Example 1 except that the thickness of the layer 14 formed of the photosensitive resin composition A was changed to 20 μm, the thickness of the layer 16 formed of the photosensitive resin composition B was changed to 4 μm, and the thickness h of the ejection orifice-forming member layer A 6 over the channel 4 was changed to 5 μm. The dimensions of components of the obtained inkjet recording head are described in Table 5.

Comparative Example 1

In this Comparative Example, the steps illustrated in FIGS. 13A to 13E were performed to produce an inkjet recording head.

Figure 13A:
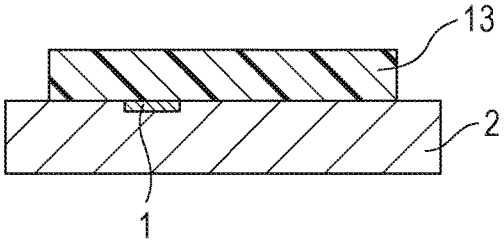
FIGS. 13A to 13E are sectional views that illustrate an example of a method for producing an inkjet recording head in the related art.

As illustrated in FIG. 13A, in the same manner as in Example 1, on a substrate 2, a shape member 13 used for forming a liquid channel was formed from a channel-forming resin composition.

Figure 13D:
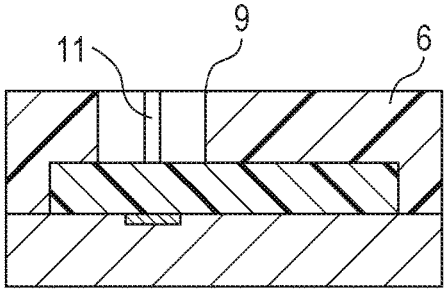
Figure 13B:
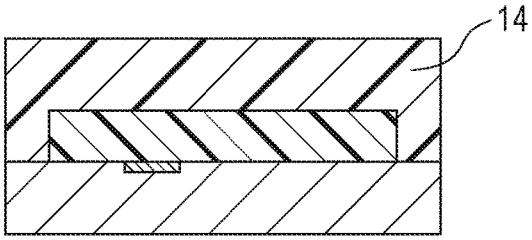

Subsequently, as illustrated in FIG. 13B, on the shape member 13 and the substrate 2, a layer 14 formed of a photosensitive resin composition A was formed. Specifically, onto the shape member 13 and the substrate 2, the photosensitive resin composition composed of the components described in Table 3 was applied by spin coating, and heat treatment was performed at 90° C. for 5 minutes to form the layer 14 formed of the photosensitive resin composition A and having a thickness of 25 μm.

Figure 13E:
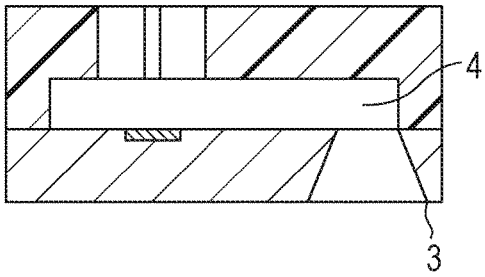
Figure 13C:
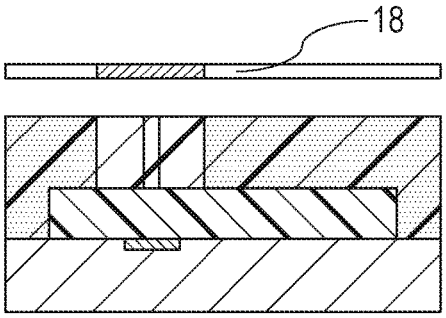

Subsequently, as illustrated in FIG. 13C, the layer 14 formed of the photosensitive resin composition A was exposed, to thereby form a pattern of ejection orifices 9 and protrusions 11, which protruded into the ejection orifices 9. Specifically, the layer 14 formed of the photosensitive resin composition A was patterned by exposure with an i-line exposure stepper, at an exposure dose of 4000 J/m$^2$, and through an ejection orifice pattern mask 18 having a pattern for the ejection orifices 9 and the protrusions 11.

Subsequently, as illustrated in FIG. 13D, the unexposed regions were removed from the layer 14 formed of the photosensitive resin composition A. Specifically, heating was performed at 90° C. for 4 minutes to cure the exposed regions, and the unexposed regions were then dissolved and removed with PGMEA from the layer 14 formed of the photosensitive resin composition A. As a result, the following were formed: the ejection orifice-forming member layer A 6, the ejection orifices 9, and the protrusion 11.

Subsequently, as illustrated in FIG. 13E, as in Example 1, a liquid supply passage 3 was formed in the substrate 2, and the shape member 13 was removed to form a liquid channel 4. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 5.

Comparative Example 2

An inkjet recording head was produced as in Comparative Example 1 except that the thickness of the layer 14 formed of the photosensitive resin composition A was changed to 18 μm. The dimensions of components of the obtained inkjet recording head are described in Table 5.

Comparative Example 3

An inkjet recording head was produced as in Comparative Example 1 except that, in the step illustrated in FIG. 13C, exposure was performed through an ejection orifice pattern mask 18 that had the pattern for the ejection orifices 9 but did not have the pattern for the protrusions 11. The dimensions of components of the obtained inkjet recording head are described in Table 5.

TABLE 5

| | Examples 1 to 3 | Example 4 | Example 5 | Comparative Example 1 | Comparative Example 2 | Comparative Example 3 |
|---|---|---|---|---|---|---|
| Channel height | 15 μm | | | | | |
| Φ1 | 14.8 μm | | | | | |
| Φ2 | 12.8 μm | | | | | |
| H | 11 μm | | | | 3 μm | 11 μm |
| x | 3.5 μm | | | | | — |
| y | 3.9 μm | | | | | — |
| h | 3 μm | | 5 μm | — | — | — |
| d | 1 μm | 0.5 μm | 1 μm | — | — | — |

Evaluations

An ink having a viscosity of 2.4 cps and a surface tension of 33 dyn/cm was charged into each of the inkjet recording heads produced in Examples 1 to 5 and Comparative Examples 1 to 3, and these inkjet recording heads were evaluated in the following manner.

Evaluation for Post-Termination Printing

Printing was terminated for a printing termination period of 0.9 seconds or 2.7 seconds, and then printing was performed again and evaluated as to whether or not the ink was normally ejected, on the basis of the following evaluation grades. The results are summarized in Table 6.

Good: Ink is normally ejected even after the printing termination period.

Poor: Ink cannot be normally ejected after the printing termination period.

Evaluation for Printing for 1000 Sheets

The printing quality after printing for 1000 sheets was evaluated on the basis of the following evaluation grades. The results are summarized in Table 6.

Good: the amount of satellite droplets generated is small, and the degree of misdirection of ink droplets is low, so that the image quality is not adversely affected.

Poor: in addition to main ink droplets, satellite droplets are generated and degrade the image quality.

Very poor: misfiring of ink droplets or misdirection of ink droplets occurs and considerably degrades the image quality.

TABLE 6

| | | Examples 1 to 3 | Example 4 | Example 5 | Comparative Example 1 | Comparative Example 2 | Comparative Example 3 |
|---|---|---|---|---|---|---|---|
| Evaluation for post-termination printing | 0.9 seconds | Good | Good | Good | Good | Good | Good |
| | 2.7 seconds | Good | Good | Good | Poor | Good | Good |
| Evaluation for printing for 1000 sheets | | Good | Good | Good | Good | Very poor | Poor |

As shown in Table 6, in the evaluation for post-termination printing, the inkjet recording heads of Examples 1 to 5 were evaluated as performing normal ejection of ink even after the printing termination period. In addition, the inkjet recording heads of Examples 1 to 5 were evaluated as providing high printing quality even after printing for 1000 sheets. On the other hand, in the inkjet recording head of Comparative Example 1, after a printing termination period of 2.7 seconds, misfiring of the ink occurred, or the ink was not normally ejected and misdirected. In the inkjet recording head of Comparative Example 2, in the evaluation for printing for 1000 sheets, the initial printing quality was good; however, the printing quality was gradually degraded. After the printing for 1000 sheets, observation of the ejection orifice-forming member of the inkjet recording head of Comparative Example 2 revealed cracking at several sites. This was probably caused because the ejection orifice-forming member was thin and had low rigidity, and the force applied by wiping caused the cracking. In the inkjet recording head of Comparative Example 3, after the printing for 1000 sheets, misdirection occurred for main droplets and satellite droplets.

Example 6

In this Example, the steps illustrated in FIGS. 11A to 11G were performed to produce an inkjet recording head. Incidentally, in the steps illustrated in FIGS. 11A to 11G, on the layer 16 formed of the photosensitive resin composition B, the layer 17 formed of the photosensitive resin composition D and being curable into the surface water-repellent layer 10, is formed. However, in this Example, the layer 17 formed of the photosensitive resin composition D was not formed.

As illustrated in FIG. 11A, on a substrate 2, a shape member 13 used for forming a liquid channel and formed of a channel-forming resin composition was formed. Specifically, onto the substrate 2 formed of silicon in which energy generating elements 1 for generating energy for ejecting liquid were disposed, polymethyl isopropenyl ketone (manufactured by TOKYO OHKA KOGYO CO., LTD., trade name: ODUR-1010) was applied. After that, heat treatment was performed at 120° C. for 5 minutes, to form a layer having a thickness of 15 μm and formed of the channel-forming resin composition. The layer formed of the channel-forming resin composition was exposed through a channel pattern mask with an exposure system UX3000 (trade name, manufactured by USHIO INC.). The exposed regions were dissolved and removed with MIBK. Thus, the shape member 13 was formed.

Subsequently, as illustrated in FIG. 11B, on the shape member 13 and the substrate 2, a layer 14 formed of a photosensitive resin composition A and a layer 15 formed of a photosensitive resin composition C were formed in this order. Specifically, onto the shape member 13 and the substrate 2, a photosensitive resin composition was applied by spin coating, the photosensitive resin composition being curable into an ejection orifice-forming member layer A 6 and composed of the components described in Table 7. After that, heat treatment was performed at 90° C. for 5 minutes, to form the layer 14 formed of the photosensitive resin composition A and having a thickness of 18 μm. Furthermore, onto the layer 14 formed of the photosensitive resin composition A, a photosensitive resin composition was applied by slit coating, the photosensitive resin composition being curable into an intermediate water-repellent layer 7 and composed of the components described in Table 8. After that, heat treatment was performed at 50° C. for 3 minutes, to form the layer 15 formed of the photosensitive resin composition C and having a thickness of 2 m.

TABLE 7

| | Trade names and manufacturers | Content (Parts by mass) |
|---|---|---|
| Epoxy resin | 157S70, manufactured by Mitsubishi Chemical Corporation | 100.0 |
| Photoacid generating agent | ADEKA OPTOMER SP-172, manufactured by ADEKA CORPORATION | 5.0 |
| Acid generating agent | TPS-1000, manufactured by Midori Kagaku Co., Ltd. | 0.2 |
| Silane coupling agent | A-187, manufactured by Momentive Performance Materials Inc. | 5.0 |
| Solvent (PGMEA) | — | 120.0 |

TABLE 8

| | Trade names and manufacturers | Content (Parts by mass) |
|---|---|---|
| Silane condensate | — | 1.0 |
| Epoxy resin | EHPE3150, manufactured by Daicel Corporation | 5.9 |
| Photoacid generating agent | CPI-410S, manufactured by San-Apro Ltd. | 0.1 |
| Solvent (ethanol) | — | 80.0 |

Incidentally, in Table 8, the silane condensate was prepared in the following manner. To a flask equipped with a condenser, the following compounds were added: 12.53 g (0.045 mol) of γ-glycidoxypropyltriethoxysilane, 8.02 g (0.0225 mol) of methyltriethoxysilane, 4.46 g (0.0225 mol) of phenyltrimethoxysilane, 0.96 g (0.726 mmol) of a compound represented by Formula (1) above, 5.93 g of water, 15.15 g of ethanol, and 3.83 g of hydrofluoroether (trade name: HFE7200, manufactured by Sumitomo 3M Limited). These compounds were stirred at room temperature for 5 minutes, and then heated to reflux for 24 hours. Thus, the silane condensate was prepared.

The photosensitive resin composition described in Table 7 was used to form a film on a silicon substrate. The film was exposed at 10000 J/m$^2$, and heat treatment was performed at 90° C. for 5 minutes. The resultant cured product was found to have a static contact angle for pure water ($\theta_A$, $\theta_B$) of 59°. The photosensitive resin composition described in Table 8 was used to form a film on a silicon substrate. The film was exposed at 1000 J/m$^2$, and heat treatment was performed at 90° C. for 5 minutes. The resultant cured product was found to have a static contact angle for pure water ($\theta_s$) of 98°. Incidentally, the static contact angles were measured with a contact angle meter CA-X150 (trade name, manufactured by Kyowa Interface Science Co., Ltd.) and as contact angles for a 10 μl pure water droplet.

Subsequently, as illustrated in FIG. 11C, on the layer 15 formed of the photosensitive resin composition C, a layer 16 formed of a photosensitive resin composition B was formed. Specifically, the photosensitive resin composition described in Table 7 and being curable into an ejection orifice-forming member layer B 8 was used to form a dry film. This dry film was disposed, by a lamination process, on the layer 15 formed of the photosensitive resin composition C. As a result, the layer 16 formed of the photosensitive resin composition B and having a thickness of 6 μm was formed. The dry film was prepared by applying, by spin coating, the photosensitive resin composition described in Table 7 onto a PET film having a thickness of 100 μm, and by heating the applied composition at 90° C. for 5 minutes to evaporate the solvent.

Subsequently, as illustrated in FIG. 11D, the layer 14 formed of the photosensitive resin composition A, the layer 15 formed of the photosensitive resin composition C, and the layer 16 formed of the photosensitive resin composition B were exposed, to thereby form a pattern of ejection orifices 9 and protrusions 11, which protruded into the ejection orifices 9. Specifically, the layer 14 formed of the photosensitive resin composition A, the layer 15 formed of the photosensitive resin composition C, and the layer 16 formed of the photosensitive resin composition B were patterned by exposure through an ejection orifice pattern mask 18 having a pattern for the ejection orifices 9 and the protrusions 11. The exposure was performed with an i-line exposure stepper at an exposure dose of 10000 J/m$^2$.

Subsequently, as illustrated in FIG. 11E, the layer 15 formed of the photosensitive resin composition C was exposed, to thereby form a pattern of water-repellent projection portions 12. Specifically, the layer 15 formed of the photosensitive resin composition C was patterned by exposure at an exposure dose of 1000 J/m$^2$, with an i-line exposure stepper, and through a water-repellent projection portion pattern mask 19 having a pattern for the water-repellent projection portions 12. Incidentally, the curing exposure dose Eth1 for the photosensitive resin composition A, the curing exposure dose Eth2 for the photosensitive resin composition B, and the curing exposure dose Eth3 for the photosensitive resin composition C satisfied Eth1>Eth3 and Eth2>Eth3. As a result, in this exposure, only the layer 15 formed of the photosensitive resin composition C was partially cured by the patterning exposure.

Subsequently, as illustrated in FIG. 11F, the unexposed regions were removed from the layer 14 formed of the photosensitive resin composition A, the layer 15 formed of the photosensitive resin composition C, and the layer 16 formed of the photosensitive resin composition B. Specifically, heating was performed at 90° C. for 4 minutes to cure the exposed regions, and then the unexposed regions were dissolved and removed with PGMEA from the layer 14 formed of the photosensitive resin composition A, the layer 15 formed of the photosensitive resin composition C, and the layer 16 formed of the photosensitive resin composition B. As a result, the following were formed: the ejection orifice-forming member layer A 6, the intermediate water-repellent layer 7, the ejection orifice-forming member layer B 8, the ejection orifices 9, the protrusions 11, and the water-repellent projection portions 12.

Subsequently, as illustrated in FIG. 11G, a liquid supply passage 3 was formed in the substrate 2, and the shape member 13 was removed. Specifically, the ejection orifice-forming member on the substrate 2 was protected with a rubber film, and then an alkaline etchant was used to form the supply passage 3 in the substrate 2. After that, the rubber film was removed, and the shape member 13 was dissolved and removed with methyl lactate to thereby form a liquid channel 4. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 10. Incidentally, the symbols in Table 10 correspond to those in FIGS. 9A, 9B, and 9D.

Example 7

In this Example, the steps illustrated in FIGS. 12A to 12G were performed to produce an inkjet recording head.

As illustrated in FIG. 12A, in the same manner as in Example 6, on a substrate 2, a shape member 13 used for forming a liquid channel was first formed from a channel-forming resin composition.

Subsequently, as illustrated in FIG. 12B, on the shape member 13 and the substrate 2, a layer 14 formed of a photosensitive resin composition A was formed and exposed, to thereby form a pattern of ejection orifices 9 and protrusions 11, which protruded into the ejection orifices 9. Specifically, in the same manner as in Example 6, the layer 14 formed of the photosensitive resin composition A was formed. After that, the layer 14 formed of the photosensitive resin composition A was patterned by exposure at an exposure dose of 10000 J/m$^2$, with an i-line exposure stepper, and through an ejection orifice pattern mask 20 having a pattern for the ejection orifices 9 and the protrusions 11.

Subsequently, as illustrated in FIG. 12C, on the layer 14 formed of the photosensitive resin composition A, a layer 15 formed of a photosensitive resin composition C was formed and exposed, to thereby form a pattern of the ejection orifices 9, protrusions 11, which protruded into the ejection orifices 9, and water-repellent projection portions 12. Specifically, in the same manner as in Example 6, the layer 15 formed of the photosensitive resin composition C was formed. After that, the layer 15 formed of the photosensitive resin composition C was patterned by exposure with an i-line exposure stepper, at an exposure dose of 1000 J/m$^2$, and through a water-repellent projection portion pattern mask 19 having a pattern for the ejection orifices 9, the protrusions 11, and the water-repellent projection portions 12. Incidentally, the curing exposure dose Eth1 for the photosensitive resin composition A and the curing exposure dose Eth3 for the photosensitive resin composition C satisfied Eth1>Eth3. As a result, in this exposure, only the layer 15 formed of the photosensitive resin composition C was partially cured by the patterning exposure.

Subsequently, as illustrated in FIG. 12D, the unexposed regions were removed from the layer 14 formed of the photosensitive resin composition A and the layer 15 formed of the photosensitive resin composition C. Specifically, heating was performed at 90° C. for 4 minutes to cure the exposed regions, and the unexposed regions were then dissolved and removed with PGMEA from the layer 14 formed of the photosensitive resin composition A and the layer 15 formed of the photosensitive resin composition C. As a result, the following were formed: the ejection orifice-forming member layer A 6, the intermediate water-repellent layer 7, portions of the protrusions 11, and the water-repellent projection portions 12.

Subsequently, as illustrated in FIG. 12E, on the intermediate water-repellent layer 7 and the ejection orifice-forming member layer A 6, a layer 16 formed of a photosensitive resin composition B was formed, and exposed, to thereby form a pattern of ejection orifices 9 and protrusions 11. Specifically, a dry film was prepared from a photosensitive resin composition described in Table 9, and was disposed by a lamination process on the intermediate water-repellent layer 7 and the ejection orifice-forming member layer A 6. Thus, the layer 16 formed of the photosensitive resin composition B and having a thickness of 6 μm was formed. The dry film was prepared by applying the photosensitive resin composition described in Table 9 by spin coating to a PET film having a thickness of 100 μm, and by heating the applied composition at 90° C. for 5 minutes to evaporate the solvent. After that, the layer 16 formed of the photosensitive resin composition B was patterned by exposure with an i-line exposure stepper, at an exposure dose of 4000 J/m$^2$, and through an ejection orifice pattern mask 18 having a pattern for the ejection orifices 9 and the protrusions 11.

TABLE 9

| | Trade names and manufacturers | Content (Parts by mass) |
|---|---|---|
| Epoxy resin | EHPE3150, manufactured by Daicel Corporation | 100.0 |
| Additive | 1,4-HFAB, manufactured by Central Glass Co., Ltd. | 20.0 |
| Photoacid generating agent | ADEKA OPTOMER SP-172, manufactured by ADEKA CORPORATION | 8.0 |
| Silane coupling agent | A-187, manufactured by Momentive Performance Materials Inc. | 5.0 |
| Solvent (xylene) | — | 140.0 |

Incidentally, the photosensitive resin composition described in Table 9 was used to form a film on a silicon substrate, and the film was exposed at 4000 J/m$^2$ and subjected to heat treatment at 90° C. for 5 minutes. The resultant cured product was found to have a static contact angle for pure water ($\theta_B$) of 60°.

Subsequently, as illustrated in FIG. 12F, the unexposed regions were removed from the layer 16 formed of the photosensitive resin composition B. Specifically, heating was performed at 90° C. for 4 minutes to cure the exposed regions, and then the unexposed regions were dissolved and removed with MIBK from the layer 16 formed of the photosensitive resin composition B. As a result, the following were formed: the ejection orifice-forming member layer B 8, the ejection orifices 9, and the protrusions 11.

Subsequently, as illustrated in FIG. 12G, as in Example 6, a liquid supply passage 3 was formed in the substrate 2, and the shape member 13 was removed to form a liquid channel 4. Furthermore, heating was performed at 200° C. for 1 hour to achieve heat-curing. After that, electrical connections were established, and an ink supply unit was appropriately disposed. Thus, an inkjet recording head was obtained. The dimensions of components of the obtained inkjet recording head are described in Table 10.

Example 8

An inkjet recording head was produced as in Example 6 except that the pattern of the water-repellent projection portion pattern mask 19 was changed such that the water-repellent projection portions 12 had a projection length d of 1.0 μm. The dimensions of components of the obtained inkjet recording head are described in Table 10.

Example 9

An inkjet recording head was produced as in Example 6 except that the pattern of the water-repellent projection portion pattern mask 19 was changed such that the water-repellent projection portions 12 had a projection length d of 1.5 μm. The dimensions of components of the obtained inkjet recording head are described in Table 10.

Comparative Example 4

An inkjet recording head was produced as in Comparative Example 1 except that the thickness of the layer 14 formed of the photosensitive resin composition A was changed to 26 μm, and the length y of the protrusions 11 was changed to 3.3 μm. The dimensions of components of the obtained inkjet recording head are described in Table 10.

Comparative Example 5

An inkjet recording head was produced as in Comparative Example 4 except that the length y of the protrusions 11 was changed to 3.9 μm. The dimensions of components of the obtained inkjet recording head are described in Table 10.

TABLE 10

| | Example 6 | Example 7 | Example 8 | Example 9 | Comparative Example 4 | Comparative Example 5 |
|---|---|---|---|---|---|---|
| Channel height | 15 μm | | | | | |
| Φ1 | 14.8 μm | | | | | |
| Φ2 | 12.8 μm | | | | | |
| H | 11 μm | | | | | |
| x | 3.5 μm | | | | | |
| y | 2.8 μm | 3.4 μm | 2.8 μm | 2.0 μm | 3.3 μm | 3.9 μm |
| h | 3 μm | | | | — | — |
| d | 0.5 μm | | 1.0 μm | 1.5 μm | — | — |

Evaluations

An ink having a viscosity of 2.4 cps and a surface tension of 33 dyn/cm was charged into each of the inkjet recording heads produced in Examples 6 to 9 and Comparative Examples 4 and 5, and these inkjet recording heads were evaluated in the following manner.

Evaluation for Post-Termination Printing

Printing was terminated for a printing termination period of 0.9 seconds, 1.8 seconds, or 2.7 seconds, and then printing was performed again and evaluated as to whether or not the ink was normally ejected, on the basis of the following evaluation grades. The results are summarized in Table 11.

Good: Ink is normally ejected even after the printing termination period.

Poor: Ink cannot be normally ejected after the printing termination period.

Evaluation for Printing for 1000 Sheets

The printing quality after printing for 1000 sheets was evaluated on the basis of the following evaluation grades. The results are summarized in Table 11.

Good: the image quality is good even after printing for 1000 sheets.

TABLE 11

| | | Example 6 | Example 7 | Example 8 | Example 9 | Comparative Example 4 | Comparative Example 5 |
|---|---|---|---|---|---|---|---|
| Evaluation for post-termination printing | 0.9 seconds | Good | Good | Good | Good | Good | Good |
| | 1.8 seconds | Good | Good | Good | Good | Good | Poor |
| | 2.7 seconds | Good | Good | Good | Good | Poor | Poor |
| Evaluation for printing for 1000 sheets | | Good | Good | Good | Good | Good | Good |

As shown in Table 11, in the evaluation for post-termination printing, the inkjet recording heads of Examples 6 to 9 were evaluated as performing normal ejection of ink even after the printing termination period. In addition, the inkjet recording heads of Examples 6 to 9 were evaluated as providing high printing quality even after printing for 1000 sheets. On the other hand, in the inkjet recording heads of Comparative Examples 4 and 5, after a printing termination period of 2.7 seconds in Comparative Example 4 and after a printing termination period of 1.8 seconds in Comparative Example 5, misfiring of the ink occurred, or the ink was not normally ejected and misdirected.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-189754 filed Sep. 28, 2016, and No. 2016-189755 filed Sep. 28, 2016, which are hereby incorporated by reference herein in their entirety.

What is claimed is:

1. A liquid ejection head comprising:

a substrate; and an ejection orifice-forming member formed on the substrate and including an ejection orifice configured to eject liquid and a liquid channel communicating with the ejection orifice, wherein the ejection orifice-forming member includes an ejection orifice-forming member layer A, an intermediate water-repellent layer, and an ejection orifice-forming member layer B in this order from a substrate-side of the member, the ejection orifice-forming member includes a protrusion protruding into the ejection orifice, and the ejection orifice-forming member includes a water-repellent projection portion that is at least a portion of the intermediate water-repellent layer and that projects farther into the ejection orifice than the ejection orifice-forming member layer A and the ejection orifice-forming member layer B.

2. The liquid ejection head according to claim 1, wherein the water-repellent projection portion is formed at least on an area of an inner wall of the ejection orifice, the area not being a surface of the protrusion.

3. The liquid ejection head according to claim 1, wherein the water-repellent projection portion is formed at least on a surface of a tip of the protrusion on an inner wall of the ejection orifice.

4. The liquid ejection head according to claim 1, wherein the water-repellent projection portion has a projection length d smaller than a length y of the protrusion.

5. The liquid ejection head according to claim 1, wherein a static contact angle $\theta_s$ of the water-repellent projection portion for pure water, a static contact angle $\theta_A$ of the ejection orifice-forming member layer A for pure water, and a static contact angle $\theta_B$ of the ejection orifice-forming member layer B for pure water satisfy $\theta_s>\theta_A$ and $\theta_s>\theta_B$.

6. The liquid ejection head according to claim 1, wherein a static contact angle $\theta_s$ of the water-repellent projection portion for pure water satisfies $\theta_s>70°$.

7. The liquid ejection head according to claim 1, wherein the intermediate water-repellent layer is formed of a cured product of a composition containing a condensate of a hydrolyzable silane compound having an epoxy group and a hydrolyzable silane compound having a perfluoropolyether group or a perfluoroalkyl group, a cationically polymerizable resin having two or more epoxy groups, and a photoacid generating agent that generates acid upon absorption of light.

8. The liquid ejection head according to claim 1, wherein at least one of the ejection orifice-forming member layer A and the ejection orifice-forming member layer B is formed of a cured product of a composition containing a cationically polymerizable resin having two or more epoxy groups, and a photoacid generating agent that generates acid upon absorption of light.

9. The liquid ejection head according to claim 1, wherein a surface water-repellent layer is formed on a first surface of the ejection orifice-forming member, the first surface having the ejection orifice being exposed.

10. A method for producing a liquid ejection head, comprising:

a step of forming, on a substrate, a shape member used for forming a liquid channel and formed of a channel-forming resin composition;

a step of forming, on the shape member and the substrate, a layer that is formed of a photosensitive resin composition A and that is curable into an ejection orifice-forming member layer A;

a step of forming, on the layer formed of the photosensitive resin composition A, a layer that is formed of a photosensitive resin composition C and that is curable into an intermediate water-repellent layer;

a step of forming, on the layer formed of the photosensitive resin composition C, a layer that is formed of a photosensitive resin composition B and that is curable into an ejection orifice-forming member layer B;

a step of exposing the layer formed of the photosensitive resin composition A, the layer formed of the photosensitive resin composition C, and the layer formed of the photosensitive resin composition B, to form a pattern of an ejection orifice for ejecting liquid, a protrusion protruding into the ejection orifice, and a water-repellent projection portion;

a step of removing unexposed regions from the layer formed of the photosensitive resin composition A, the layer formed of the photosensitive resin composition C, and the layer formed of the photosensitive resin composition B; and a step of removing the shape member, wherein the water-repellent projection portion is at least a portion of the intermediate water-repellent layer, and projects farther into the ejection orifice than the ejection orifice-forming member layer A and the ejection orifice-forming member layer B.

11. The method for producing a liquid ejection head according to claim 10, wherein the water-repellent projection portion is formed at least on an area of an inner wall of the ejection orifice, the area not being a surface of the protrusion.

12. The method for producing a liquid ejection head according to claim 10, wherein the water-repellent projection portion is formed at least on a surface of a tip of the protrusion on an inner wall of the ejection orifice.

13. The method for producing a liquid ejection head according to claim 10, wherein the water-repellent projection portion has a projection length d smaller than a length y of the protrusion.

14. The method for producing a liquid ejection head according to claim 10, wherein a static contact angle $\theta_s$ of the water-repellent projection portion for pure water, a static contact angle $\theta_A$ of the ejection orifice-forming member layer A for pure water, and a static contact angle $\theta_B$ of the ejection orifice-forming member layer B for pure water satisfy $\theta_s>\theta_A$ and $\theta_s>\theta_B$.

15. The method for producing a liquid ejection head according to claim 10, wherein a static contact angle $\theta_s$ of the water-repellent projection portion for pure water satisfies $\theta_s>70°$.

16. The method for producing a liquid ejection head according to claim 10, wherein the photosensitive resin composition C contains a condensate of a hydrolyzable silane compound having an epoxy group and a hydrolyzable silane compound having a perfluoropolyether group or a perfluoroalkyl group, a cationically polymerizable resin having two or more epoxy groups, and a photoacid generating agent that generates acid upon absorption of light.

17. The method for producing a liquid ejection head according to claim 10, wherein at least one of the photosensitive resin composition A and the photosensitive resin composition B contains a cationically polymerizable resin having two or more epoxy groups and a photoacid generating agent that generates acid upon absorption of light.

18. The method for producing a liquid ejection head according to claim 10, wherein a curing exposure dose Eth1 for the photosensitive resin composition A, a curing exposure dose Eth2 for the photosensitive resin composition B, and a curing exposure dose Eth3 for the photosensitive resin composition C satisfy Eth1>Eth3 and Eth2>Eth3.

19. The method for producing a liquid ejection head according to claim 10, further comprising a step of performing heating at 90° C. or more and 250° C. or less after the step of removing the unexposed regions from the layer formed of the photosensitive resin composition A, the layer formed of the photosensitive resin composition C, and the layer formed of the photosensitive resin composition B.

* * * * *